US009988803B2

(12) United States Patent
Tani et al.

(10) Patent No.: US 9,988,803 B2
(45) Date of Patent: Jun. 5, 2018

(54) URINAL HAVING CONTINUOUSLY CURVED BOWL SURFACE

(71) Applicant: TOTO LTD., Kitakyushu-shi, Fukuoka (JP)

(72) Inventors: Minoru Tani, Kitakyushu (JP); Yusuke Takiguchi, Kitakyushu (JP); Yuichi Furuta, Kitakyushu (JP); Tomohiro Kai, Kitakyushu (JP); Hironori Yamasaki, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days. days.

(21) Appl. No.: 14/657,510

(22) Filed: Mar. 13, 2015

(65) Prior Publication Data

US 2015/0275495 A1 Oct. 1, 2015

(30) Foreign Application Priority Data

Mar. 28, 2014 (JP) ..... 2014-069464
Nov. 28, 2014 (JP) ..... 2014-242025

(51) Int. Cl.
*E03D 13/00* (2006.01)

(52) U.S. Cl.
CPC ..... *E03D 13/00* (2013.01); *E03D 2201/40* (2013.01)

(58) Field of Classification Search
CPC ..... E03D 13/00; E03D 13/007; E03D 11/025
USPC ..... 4/301, 310, 311, 300.3; D23/302, 309
See application file for complete search history.

(56) References Cited

U.S. PATENT DOCUMENTS 1,771,945 A * 7/1930 Youngblood ..... E03D 11/025 4/664
4,982,455 A * 1/1991 Carter ..... E03D 13/00 4/307
D372,962 S * 8/1996 Thomas ..... D23/302
D395,077 S * 6/1998 Nagato ..... D23/302
D547,845 S * 7/2007 Paterson ..... D23/302
D556,302 S * 11/2007 Paterson ..... D23/302
D556,303 S * 11/2007 Paterson ..... D23/302
(Continued)

FOREIGN PATENT DOCUMENTS

CN 201221128 4/2009
CN 201649258 11/2010
(Continued)

OTHER PUBLICATIONS

Machine Translation for DE19903680.*
(Continued)

*Primary Examiner* — Erin Deery
(74) *Attorney, Agent, or Firm* — Brooks Kushman P.C.

(57) ABSTRACT

A urinal having the bowl surface formed by only the front face portion in an upper region which does not have any forwardly projecting plate-like side walls at opposite sides thereof as in the conventional urinal. Flush water cleans a wider part of the bowl surface than in the prior art as well as reduce an area of the bowl surface that is not cleaned and provide an improved cleanliness and sanitation of the bowl surface. The urinal includes: a bowl surface being arranged so as to situate between a line segment connecting the left and right side edges and an arcuate segment of a circle having a diameter corresponding to the line segment, as viewed in the horizontal section through the flush water discharging device.

13 Claims, 15 Drawing Sheets

(56) References Cited

U.S. PATENT DOCUMENTS

| | | | | | |
|---|---|---|---|---|---|
| D618,323 | S * | 6/2010 | Ogawa | D23/302 | |
| 2007/0006370 | A1* | 1/2007 | Schroder | E03D 13/00 4/310 | |

FOREIGN PATENT DOCUMENTS

| | | | | |
|---|---|---|---|---|
| CN | 201801941 | | 4/2011 | |
| CN | 202990078 | | 6/2013 | |
| DE | 19903680 | A1 * | 8/2000 | E03C 1/20 |
| GB | 191314819 | A * | 3/1914 | E03D 13/00 |
| JP | S6050277 | | 4/1984 | |
| JP | H032080 | | 1/1991 | |
| JP | 06212681 | A * | 8/1994 | |
| JP | H07207740 | | 8/1995 | |
| JP | 2000303543 | | 10/2000 | |
| JP | 2002138559 | | 5/2002 | |
| JP | 2005179911 | | 7/2005 | |
| JP | 2009002115 | | 1/2009 | |
| JP | 2009121185 | | 6/2009 | |
| JP | 2009197421 | | 9/2009 | |
| JP | 2010101117 | * | 5/2010 | |
| JP | 5185067 | | 4/2013 | |

OTHER PUBLICATIONS

Website http://asia.toto.com/index.php/products/public/urinal/item/652-uw904sb-uw904shb Dated Aug. 23, 2012, 3 Pages, "TOTO Asia Oceania—UW904SB/ UW904SHB".

Written Opinion and Search Report for Singapore Application No. 1020150213S, Completed by the Singapore Patent Office dated Sep. 15, 2015, All together 11 Pages.

Japanese Office Action for Japanese Application No. 201510142415.7, Completed by the Japanese Patent Office, dated Feb. 24, 2018, 7 Pages.

Chinese Office Action for Chinese Application No. 201510142415.7, Completed by the China Patent Office, dated Feb. 24, 2018, 7 Pages.

* cited by examiner

URINAL HAVING CONTINUOUSLY CURVED BOWL SURFACE

CROSS-REFERENCE TO RELATED APPLICATIONS

This application claims priority to JP application JP 2014-069464 filed on Mar. 28, 2014 and JP application JP 2014-242025 filed on Nov. 28, 2014 disclosures of which are incorporated in their entirety by reference herein.

TECHNICAL FIELD

The present invention relates to a urinal, and more particularly, to a urinal comprising a bowl surface adapted to be cleaned by flush water which is discharged in a such a manner to spread in leftward and rightward directions from a flush water discharging device.

BACKGROUND

It has been known in the prior art to provide a urinal comprising a bowl surface having side sections composed of side walls which each project forwardly and inside of the urinal from respective left and right side edges of the bowl surface and a spreader provided on the bowl surface centrally at its upper region. In such conventional urinal, the flush water which is discharged by the spreader is not adapted to be positively directed at the side sections comprising the side walls of the bowl surface with a view to preventing the flush water from running off outside the urinal bowl surface.

It also has been proposed in Japanese Patent No. 5185067 (Patent Document No. 1) to provide a urinal comprising a bowl surface having outer wall portions outwardly surrounding respective opposite side sections of the bowl surface with a view to cleaning the side sections of the bowl surface. Such urinal may cause the flow of the discharged flush water to pass over the opposite side sections of the bowl surface and reach flush water spilled from the side sections to the surrounding outer wall portions, which may result in the reduction of the area of the side sections that is difficult to clean by means of the flush water.

It, further, has been known in the prior art, for example Japanese Patent Laid-Open Application 2014-70376 (Patent Document No. 2) to provide a urinal comprising a bowl surface having side sections composed of vertical side walls which each project forwardly and inside of the urinal from respective left and right side edges of the bowl surface, the bowl surface centrally at its upper region being backed rearwardly and downwardly so as to limit a splatter of the discharged flush water.

SUMMARY

Technical Problem

As described above, the urinal as disclosed in the Patent Document No. 1, is require to be provided with the outer wall portions which outwardly surround the bowl surface with a view to causing the flow of the discharged flush water to pass over the opposite side sections of the bowl surface and reach flush water spilled from the side sections to the surrounding outer wall portions. The manufacture of the urinal provided with the surrounding outer wall portions also require an enclosure or barrier situated outside of the whole urinal, which would undesirably produce an upsized urinal system. The demand for water conservation can lead to a reduction of amount of the flush water, which could not provide an adequate and satisfactory cleaning effect. Therefore, as a practical matter, it can be difficult to adopt the arrangement in which the bowl surface provided with the side sections is surrounded outwardly by the outer wall portions.

In the conventional urinal as disclosed in the Patent Document No. 2, the flush water which has been discharged from the spreader does not fully reach the left and right side sections which each project forwardly in the form of a vertical plate from the left and right vertical side edges therealong, which may produce an area which could have been not fully cleaned.

Thus, the present invention seeks to alleviate or eliminate the problems in the prior art as described above and to propose a urinal wherein a bowl surface is arranged to spread a discharged flush water toward left and right side edges of the bowl surface, the bowl surface is devoid of any side walls at its opposite sides thereof as in the prior art, the flush water is discharged in such a manner to spread in the leftward and rightward directions and reach an area in the vicinity of each of left and right side edges of the bowl surface to thereby flush and clean a wider part of the bowl surface than in the prior art as well as reduce an area of the bowl surface that is not cleaned by the flush water and provide an improved cleanliness and sanitation of the bowl surface.

Solution to Problem

In order to accomplish the above object, according to the present invention there is provided a urinal comprising: a urinal comprising: a bowl surface adapted to receive urine of a user and to be cleaned by a flush water; a flush water discharging device provided on the bowl surface centrally at its upper region for discharging the flush water onto the bowl surface such that the flush water spreads on the bowl surface in leftward and rightward directions; the upper region of the bowl surface on which said flush water discharging device is provided being formed by only a front face portion which faces the user, said front face portion being formed by a concavely curved surface which extends continuously in the leftward and rightward direction.

With such arrangement of the present invention in which the upper region of the bowl surface on which the flush water discharging device is provided is defined by only a front face portion which faces the user and which is formed by a concavely curved surface extending continuously in the leftward and rightward direction and having its single radius of curvature, and more particularly the upper region of the bowl surface is devoid of any forwardly projecting side walls at opposite sides thereof as found in the conventional urinal, the user can move closer to the bowl surface than as in the conventional urinal. As a result, the user's urine drip after urinating can be prevented from contaminating the floor and the user may be avoided from feeling uncomfortable.

Additionally, the upper region of the bowl surface on which the spreader is provided is defined by only the front face portion which faces the user and includes a concavely curved surface which extends continuously in the leftward/rightward direction and also is devoid of any forwardly projecting side sections at opposite sides thereof that would otherwise create portions that could be difficult to clean. Such arrangement, therefore, can promote a cleanliness of the bowl surface.

Also, the presence of the front face portion having a concavely curved surface extending continuously in the leftward/rightward direction can prevent the flush water discharged from the spreader toward the sides of the bowl surface from running off the opposite side edges of the bowl surface.

In accordance with the teachings of the present invention, the flush water discharging device is preferably configured to discharge the flush water such that it spreads diagonally upwardly on the bowl surface in the leftward and rightward directions, and the front face portion of the upper bowl region is configured to incline rearwardly from the upper portion to lower portion of the bowl surface.

In such arrangement of the invention, the flush water which has been discharged to spread diagonally upwardly in the leftward and rightward directions can flow downwardly on the front face portion of the bowl surface which is inclined downwardly and rearwardly. Accordingly, it is possible to reduce the velocity the flush water flowing diagonally upwardly in the leftward and rightward directions to limit the horizontal spread on the bowl surface of the flush water. This can prevent the flush water from being running off the side edges of the bowl surface. In this manner, such arrangement of the present invention can flush and clean a wider part of the bowl surface than in the prior art and also can prevent the running-off of the flush water.

In accordance with the teachings of the present invention, the front face portion of the upper region of the bowl surface is configured to back gradually and continuously decrease radii of curvature from the upper end to lower direction of the bowl surface.

With such arrangement of the invention in which the front face portion is configured to back gradually and continuously decrease radii of curvature downwardly from the upper end thereof, the transverse width (width in right and left direction) of the bowl surface may decrease as it proceeds downwardly. Therefore, the user can move closer to the bowl surface by comparison with the conventional urinals. Accordingly, the urine drip after urinating can be prevented from contaminating the floor and the user may be avoided from feeling uncomfortable.

Additionally, such arrangement in which the front face portion is configured to gradually extend rearwardly as the bowl surface extends downwardly from the top end thereof and has its decreasing radius of curvature, can screen the penis of the user from other surrounding persons.

In accordance with the teachings of the present invention, preferably, said bowl surface is configured such that left and right side edges which project forwardly as they proceed toward the lower direction.

With such arrangement of the present invention, a urine splash to the outside of the bowl surface can be prevented more reliably in the lower part of the bowl surface on which the user's urine is prone to impinge.

Furthermore, with such arrangement in which opposite lateral end edges of the bowl surface project increasingly forwardly, the penis of the user can be screened against view of other surrounding persons.

In accordance with the teachings of the present invention, said upper region of the bowl surface which is formed by only the front face portion is provided within an area of a distance of at least 200 mm from the upper end of the bowl surface.

With such arrangement in which the upper region of the bowl surface which is formed by only the front face portion is provided within an area of a distance of at least 200 mm from the upper end of the bowl surface. Therefore, the user's hand or arm holding the penis of the user will not come to contact with the side surface portion (side walls) of the bowl surface as in the prior art. Consequently, the user can moves closer to the front face portion of the bowl surface of the urinal by comparison with the prior art urinal.

In accordance with the teachings of the present invention, the said front face portion in the upper region of the bowl surface is configured so that tangent lines defined in the vicinity of the left and right side edges of the bowl surface forwardly extend outwardly, as viewed in the horizontal section.

With such arrangement of the present invention in which the front face portion in the upper region of the bowl surface is preferably formed so that tangent lines defined in the vicinity of the left and right side edges of the bowl surface forwardly extend outwardly in a divergent manner, as viewed in the horizontal section, the user can move closer to the front face portion of the bowl surface without contacting with the opposite sides of the bowl surface.

The present invention also relates to a urinal comprising: said bowl surface is formed by a concavely curved surface which extends continuously in the leftward and rightward direction so as to spread the flush water toward the left and right side edges direction on the bowl surface, and said bowl surface is arranged so as to situate between a line segment connecting the left and right side edges and an arcuate segment of a circle having a diameter corresponding to said line segment, as viewed in the horizontal section through the flush water discharging device.

With such arrangement, as described above, the bowl surface is arranged so as to situate between a line segment connecting the left and right side edges and an arcuate segment of a circle having a diameter corresponding to said line segment, as viewed in the horizontal section through the flush water discharging device. Accordingly, the bowl surface is arranged to spread the flush water being discharged from the flush water discharging device provided on the bowl surface centrally at its upper region, on the bowl surface in the leftward and rightward directions toward the left and right side edges of the bowl surface. As can be seen, the bowl surface is devoid of any forwardly projecting side walls at its opposite sides thereof as in the prior art that can produce the area which is difficult to clean by means of the flush water. In the urinal of the present invention, the flush water is discharged to in such a manner to spread in the leftward and rightward directions and reach an area in the vicinity of each of left and right side edges of the bowl surface to thereby flush and clean a wider part of the bowl surface than in the prior art as well as reduce an area of the bowl surface that is not cleaned by the flush water and provide an improved cleanliness and sanitation of the urine.

In accordance with the teachings of the present invention, an angle between the line segment connecting the left and right side edges and tangent lines defined at the left and right side edges of the bowl surface is defined to be greater than 0° and equal to or smaller than 60°.

With such arrangement, the bowl surface is configured so that an angle between the line segment connecting the left and right side edges and tangent lines defined at the left and right side edges of the bowl surface is defined to be greater than 0° and equal to or smaller than 60°, as viewed in the horizontal section through the flush water discharging device. Accordingly, the bowl surface is arranged to spread the flush water being discharged from the flush water discharging device provided on the bowl surface centrally at its upper region, on the bowl surface in the leftward and rightward directions toward the left and right side edges of the bowl surface. As can be seen, the bowl surface is devoid of any forwardly projecting side walls at its opposite sides thereof as in the prior art that can produce the area which is difficult to clean by means of the flush water. In the urinal of the present invention, the flush water is discharged in such a manner to spread in the leftward and rightward directions and reach an area in the vicinity of each of left and right side edges of the bowl surface to thereby flush and clean a wider part of the bowl surface than in the prior art as well as reduce an area of the bowl surface that is not cleaned by the flush water and provide an improved cleanliness and sanitation of the bowl surface.

In accordance with the teachings of the present invention, an angle between the line segment connecting the left and right side edges and tangent lines defined at the left and right side edges of the bowl surface is defined to be equal to or greater than 10° and equal to or smaller than 45°.

With such arrangement, the bowl surface is configured so that an angle between the line segment connecting the left and right side edges and tangent lines defined at the left and right side edges of the bowl surface is defined to be equal to or greater than 10° and equal to or smaller than 45°, as viewed in the horizontal section through the flush water discharging device. Accordingly, the bowl surface is arranged to spread the flush water being discharged from the flush water discharging device provided on the bowl surface centrally at its upper region, on the bowl surface in the leftward and rightward directions toward the left and right side edges of the bowl surface. As can be seen, the bowl surface is devoid of any forwardly projecting side walls at its opposite sides thereof as in the prior art that can produce the area which is difficult to clean by means of the flush water. In the urinal of the present invention, the flush water is discharged in such a manner to spread in the leftward and rightward directions and reach an area in the vicinity of each of left and right side edges of the bowl surface to thereby flush and clean a wider part of the bowl surface than in the prior art as well as reduce an area of the bowl surface that is not cleaned by the flush water and provide an improved cleanliness and sanitation of the bowl surface.

In accordance with the teachings of the present invention, a depth of the bowl surface is in the range of 40 mm to 55 mm, as viewed in the horizontal section through the flush water discharging device.

With such arrangement of the urinal of the present invention in which a depth of the bowl surface is in the range of 40 mm to 55 mm, as viewed in the horizontal section through the flush water discharging device, it is possible to spread the flush water being discharged from the flush water discharging device provided on the bowl surface centrally at its upper region, on the bowl surface in the leftward and rightward directions toward the left and right side edges of the bowl surface.

In accordance with the teachings of the present invention, the bowl surface includes a ledge extending downwardly from left and right sides of the bowl surface to forward side, the ledge guides forwardly a portion of the flush water on the bowl surface.

With such arrangement of the present invention, the ledge sections can guide thereon a portion of the flush water flowing down in the vicinity of the left and right side edges of the bowl surface forwardly thereof to reach the forward portion of the bowl surface to thereby flush and clean a wider part of the bowl surface than in the prior art as well as reduce an area of the bowl surface that is not cleaned by the flush water and provide an improved cleanliness and sanitation of the bowl surface.

In accordance with the teachings of the present invention, said ledge is formed downwardly of a location near the middle height of the bowl surface.

With such arrangement of the present invention, the ledge sections can guide thereon a portion of the flush water flowing down in the vicinity of the left and right side edges of the bowl surface forwardly thereof from the location near the middle height of the bowl surface, as viewed in the vertical direction to reach the forward portion of the bowl surface to thereby flush and clean a wider part of the bowl surface than in the prior art as well as reduce an area of the bowl surface that is not cleaned by the flush water and provide an improved cleanliness and sanitation of the bowl surface.

In the accordance with the teachings of the present invention, the single radius of curvature of the bowl surface, as viewed in the horizontal section through the flush water discharging device is defined to be equal to a range from 200 mm to 500 mm.

With such arrangement of the present invention, the single radius of curvature of the bowl surface, as viewed in the horizontal section through the flush water discharging device is defined to be equal to a range from 200 mm to 500 mm and also the bowl surface has centrally a depth corresponding to the location of the flush water discharging device that is relatively shallow. Accordingly, the bowl surface is arranged to easily guide the flush water being discharged from the flush water discharging device provided on the bowl surface centrally at its upper region, in the leftward and rightward directions toward the left and right side edges of the bowl surface. As can be seen, the bowl surface is devoid of any forwardly projecting side walls at its opposite sides thereof as in the prior art that can produce the area which is difficult to clean by means of the flush water. In the urinal of the present invention, the flush water is discharged in such a manner to spread in the leftward and rightward directions and reach an area in the vicinity of each of left and right side edges of the bowl surface to thereby flush and clean a wider part of the bowl surface than in the prior art as well as reduce an area of the bowl surface that is not cleaned by the flush water and provide an improved cleanliness and sanitation of the bowl surface.

In the accordance with the teachings of the present invention, said bowl surface is configured such that a radius of curvature of the concavely curved surface as viewed in the horizontal section continuously decreases downwardly from the upper end of the bowl surface.

With such arrangement of the present invention in which the bowl surface is configured such that a radius of curvature of the concavely curved surface as viewed in the horizontal section continuously decreases downwardly from the upper end of the bowl surface, the transverse width of the bowl surface may decrease as it proceeds downwardly. Therefore, the user can move closer to the bowl surface by comparison with the conventional urinals. Accordingly, the urine drip after urinating can be prevented from contaminating the floor and the user may be avoided from feeling uncomfortable.

Also such arrangement in which bowl surface being configured such that a radius of curvature of the concavely curved surface as viewed in the horizontal section continuously decreases downwardly from the upper end of the bowl surface, can screen the penis of the user from other surrounding persons.

Advantageous Effects of Invention

In the urinal of the present invention, a bowl surface of the urinal may spread a flush water toward left and right side edges of the bowl surface, the bowl surface is devoid of any forwardly projecting side walls at its opposite sides thereof as in the prior art, the flush water is discharged in such a manner to spread in the leftward and rightward directions and reach an area in the vicinity of each of left and right side edges of the bowl surface to thereby flush and clean a wider part of the bowl surface than in the prior art as well as reduce an area of the bowl surface that is not cleaned by the flush water and provide an improved cleanliness and sanitation of the bowl surface of the urinal.

DETAILED DESCRIPTION

Figure 1:
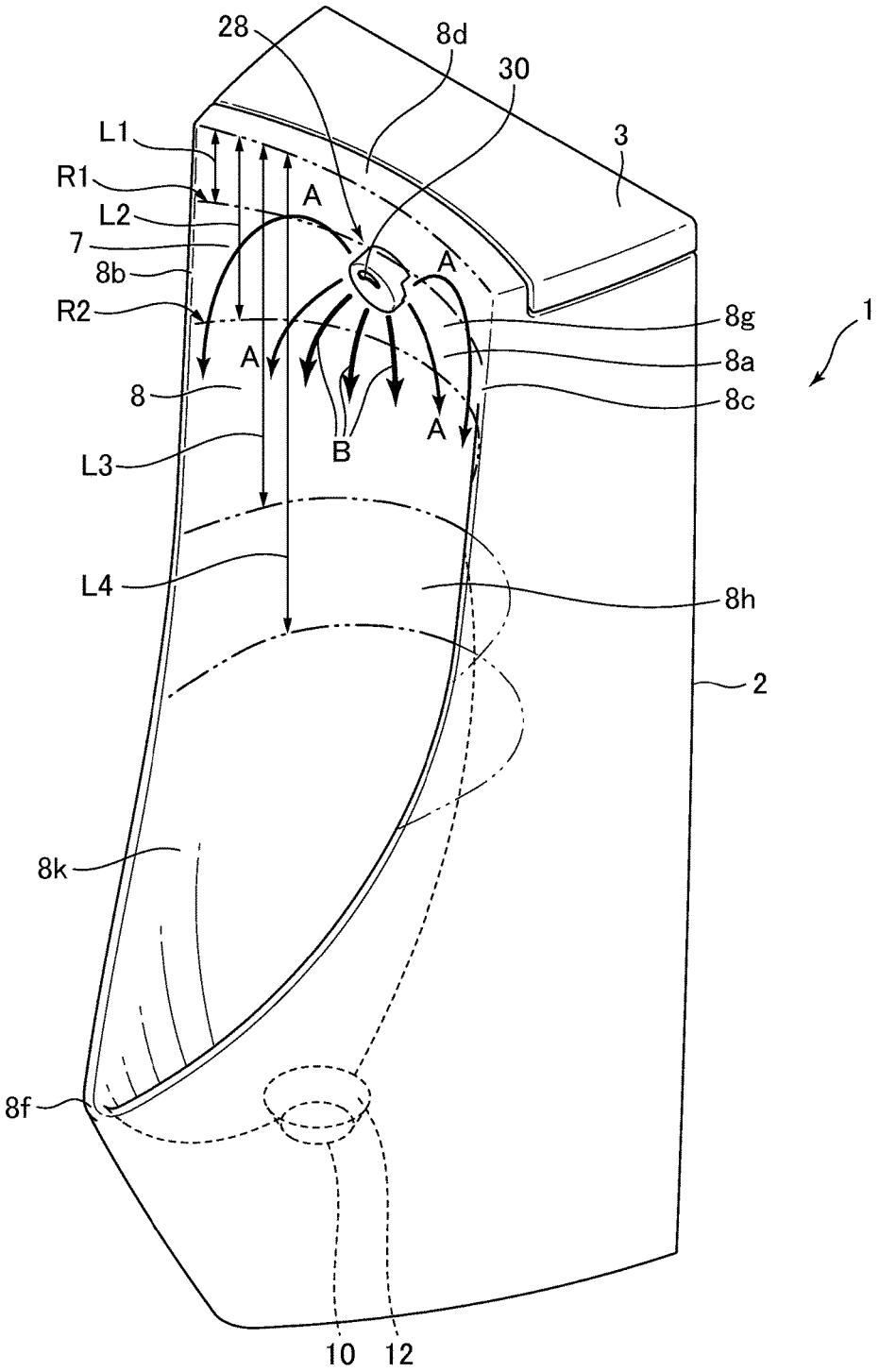
FIG. 1 is a perspective view showing, as a whole, a urinal according to a first embodiment of the present invention.
Figure 2:
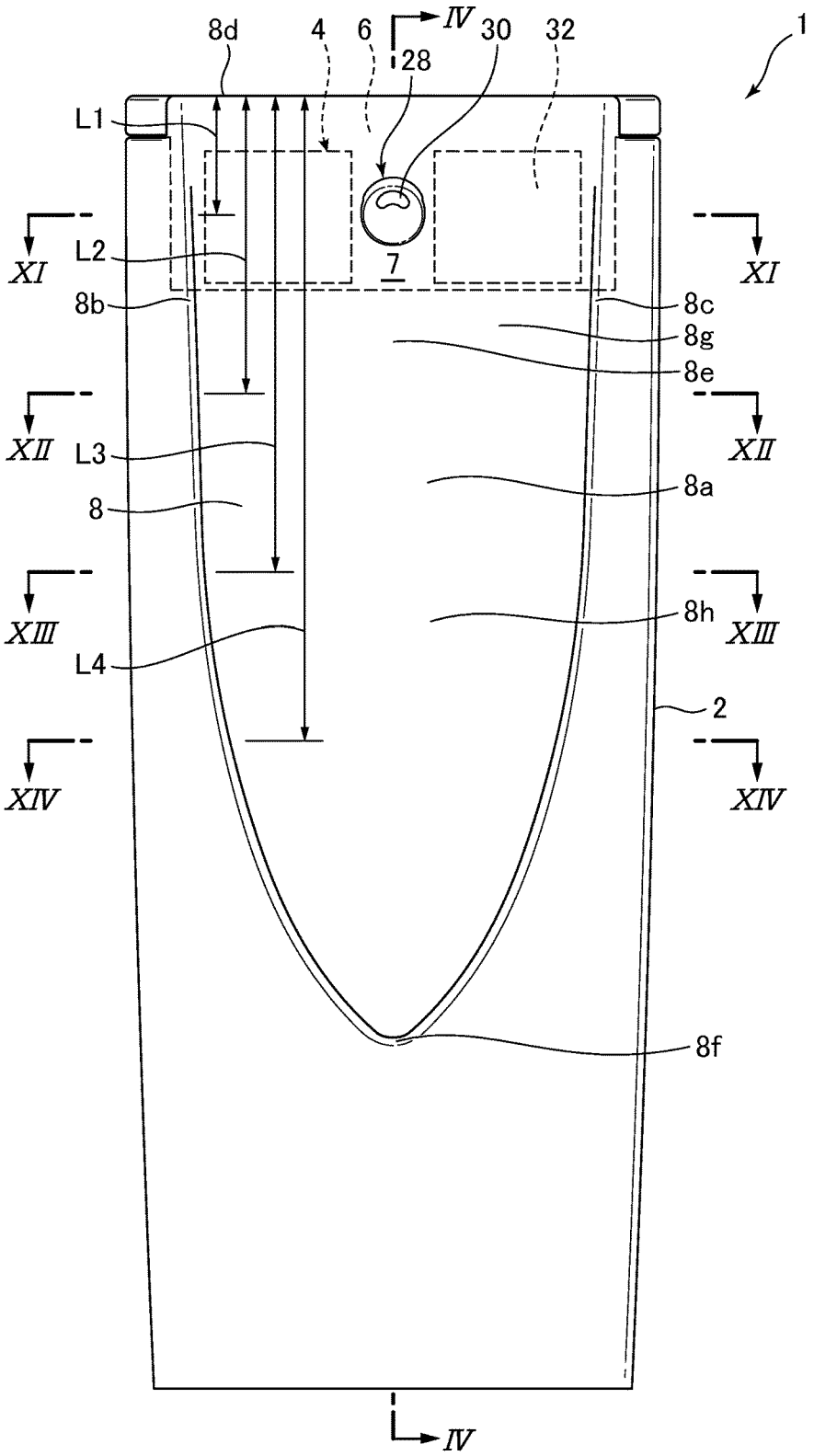
FIG. 2 is a front view of the urinal shown in FIG. 1.
Figure 3:
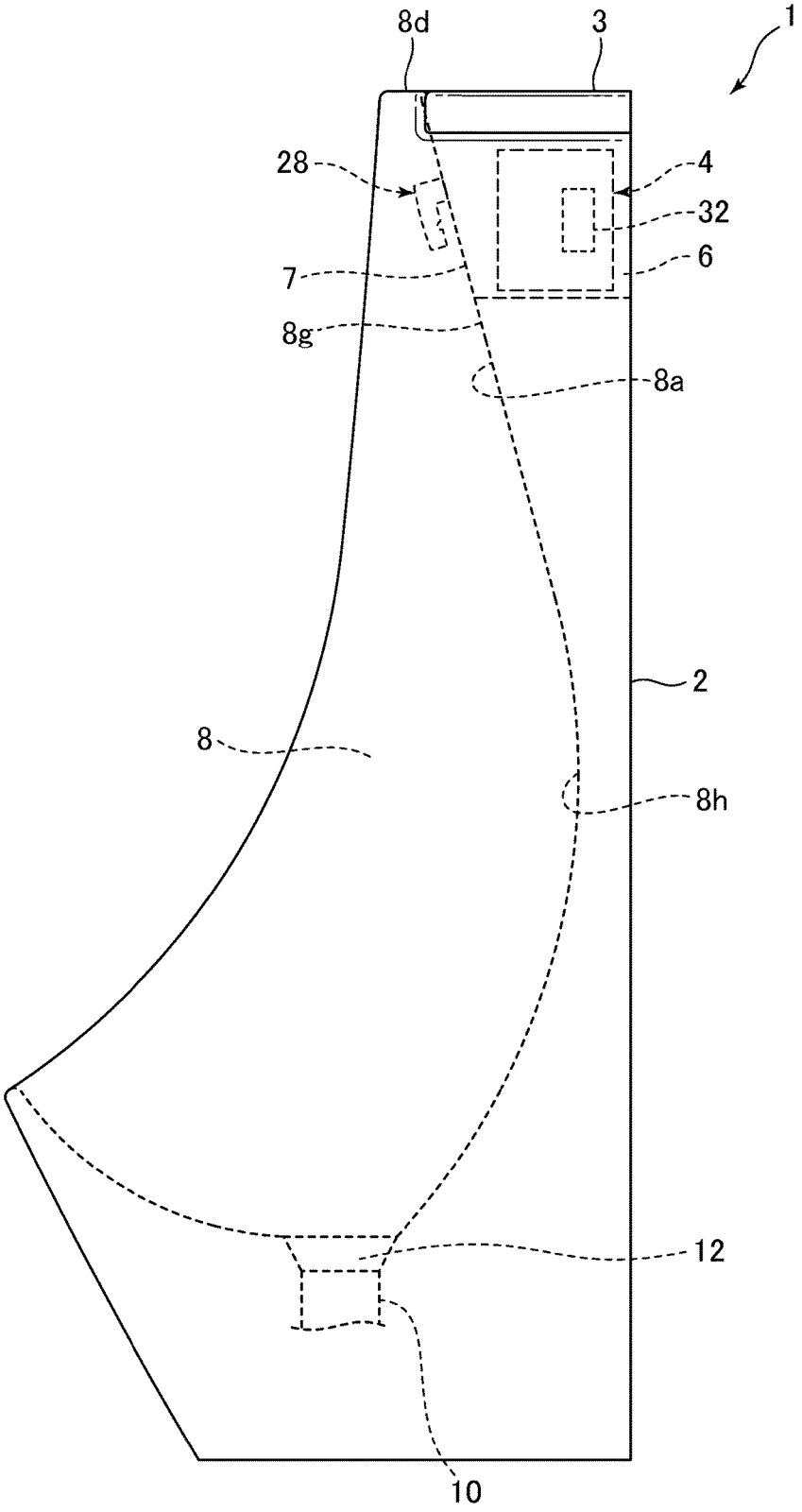
FIG. 3 is a side view of the urinal shown in FIG. 1.
Figure 4:
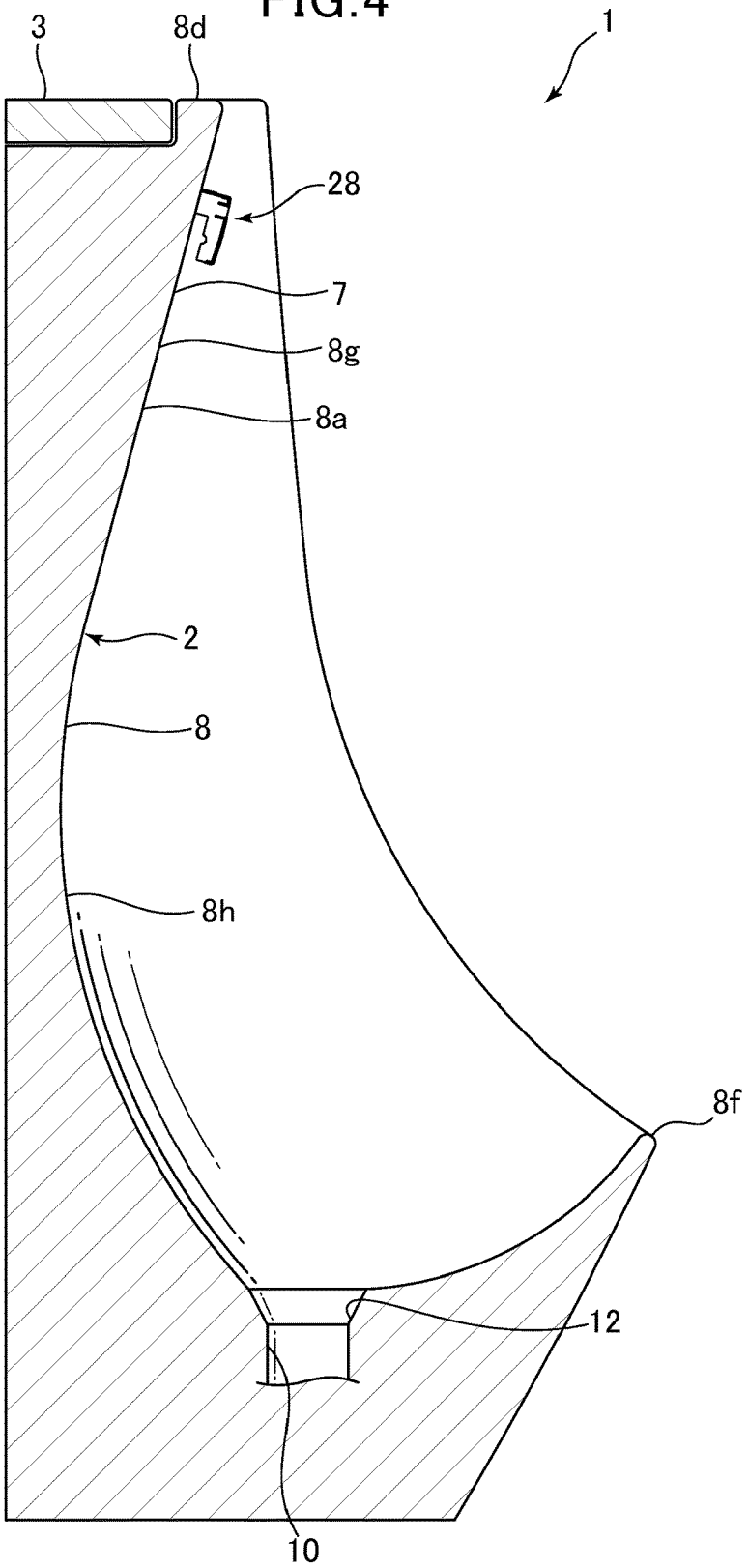
FIG. 4 is a longitudinal section of the urinal taken along the line IV-IV in FIG. 2.
Figure 5:
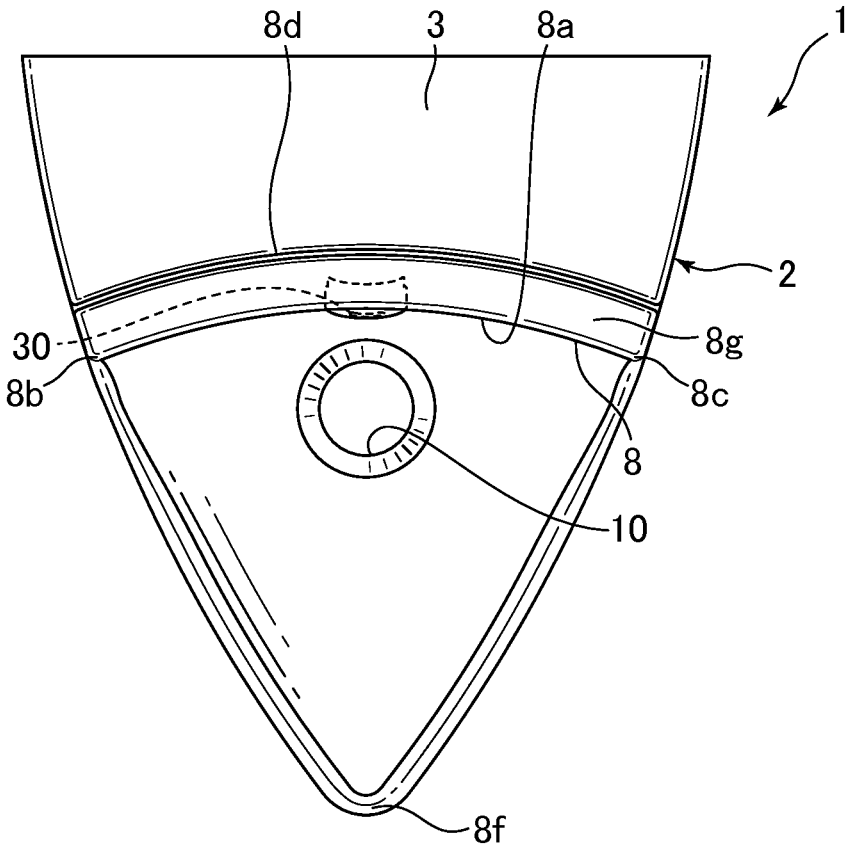
FIG. 5 is a plan view of the urinal shown in FIG. 1.

With reference to the accompanying drawings, a urinal according to a first embodiment of the present invention will be described. Firstly, the basic structure of the urinal will be described with reference to FIGS. 1 to 5. FIG. 1 is a perspective view showing, as a whole, a urinal according to an embodiment of the present invention. FIG. 2 is a front view of the urinal shown in FIG. 1. FIG. 3 is a side view of the urinal shown in FIG. 1. FIG. 4 is a longitudinal section of the urinal taken along line IV-IV in FIG. 2. FIG. 5 is a plan view of the urinal shown in FIG. 1.

As can be seen in FIGS. 1 to 5, reference numeral 1 designates the urinal according to an embodiment of the present invention. The urinal 1 comprises a urinal body 2 made of ceramic and an automated toilet flushing unit 4 for flushing the urinal body 2 (the flushing unit 4 being illustrated in phantom line in FIGS. 2 and 3 and omitted in the other figures). The urinal 1 is of a wall-mounted type, as shown wherein the urinal 1 is mounted on the back wall with its bottom suspended above floor. However, the urinal may be of a floor-standing type wherein the urinal 1 is placed directly on the floor.

The urinal body 2 of the urinal 1 comprises a housing part including a chamber or space 6 (the chamber being schematically illustrated in FIGS. 2 and 3 and omitted in the other figures) formed at its top end for housing the automated toilet flushing unit 4, a bowl surface 8 extending downwardly from a front face portion 7 of the chamber 6 and a drain hole or opening 10 formed in the bottom of the bowl surface 8.

The chamber 6 is defined by a lid 3 which is separate from the urinal body 2. The front face portion 7 of the chamber 6 is configured to incline uniquely rearwardly, as will be described hereinafter in detail. A grating plate 12 is located over the drain hole 10. The drain hole 10 is connected to a drain trapway (not shown) and drainage piping (not shown) which are placed downstream.

Figure 6:
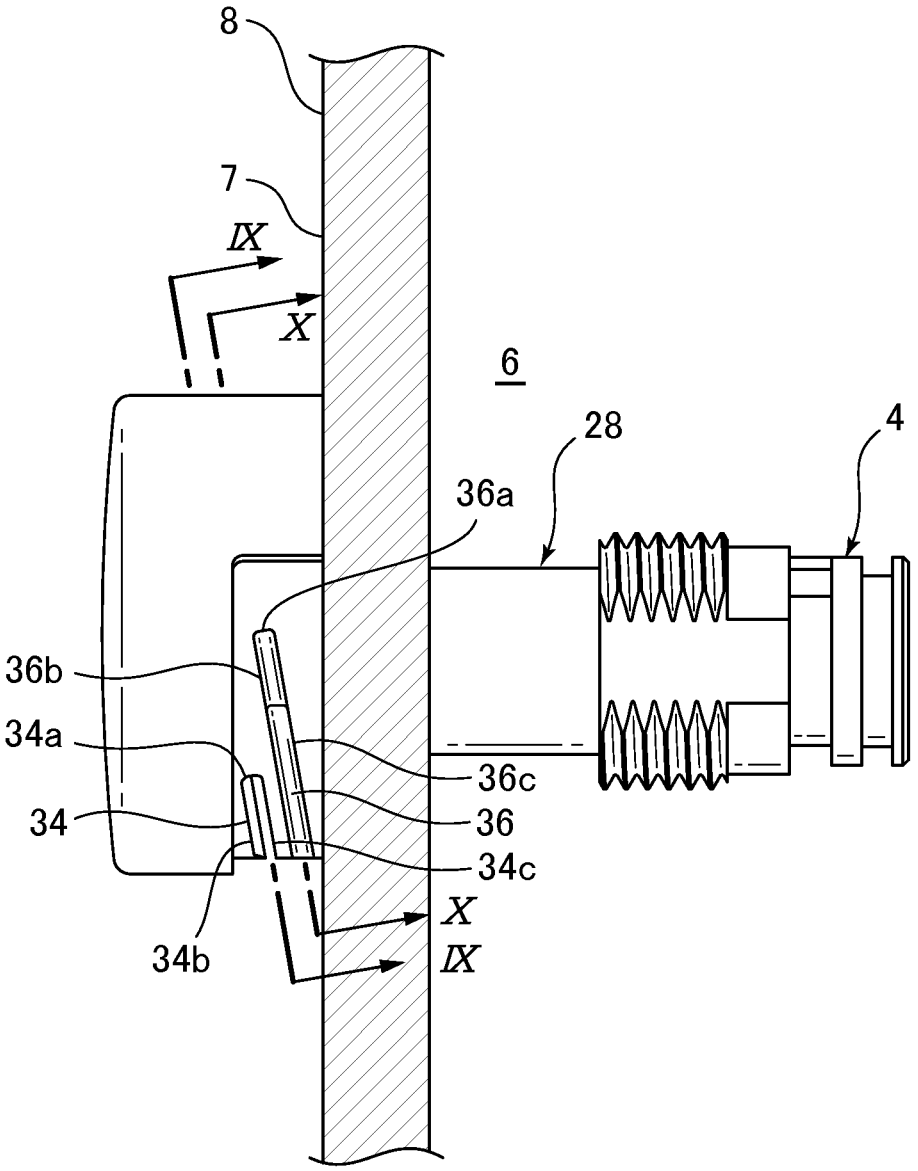
FIG. 6 is a schematic side view of the urinal of the present invention with its spreader mounted on a bowl according to the embodiment surface of the urinal.
Figure 7:
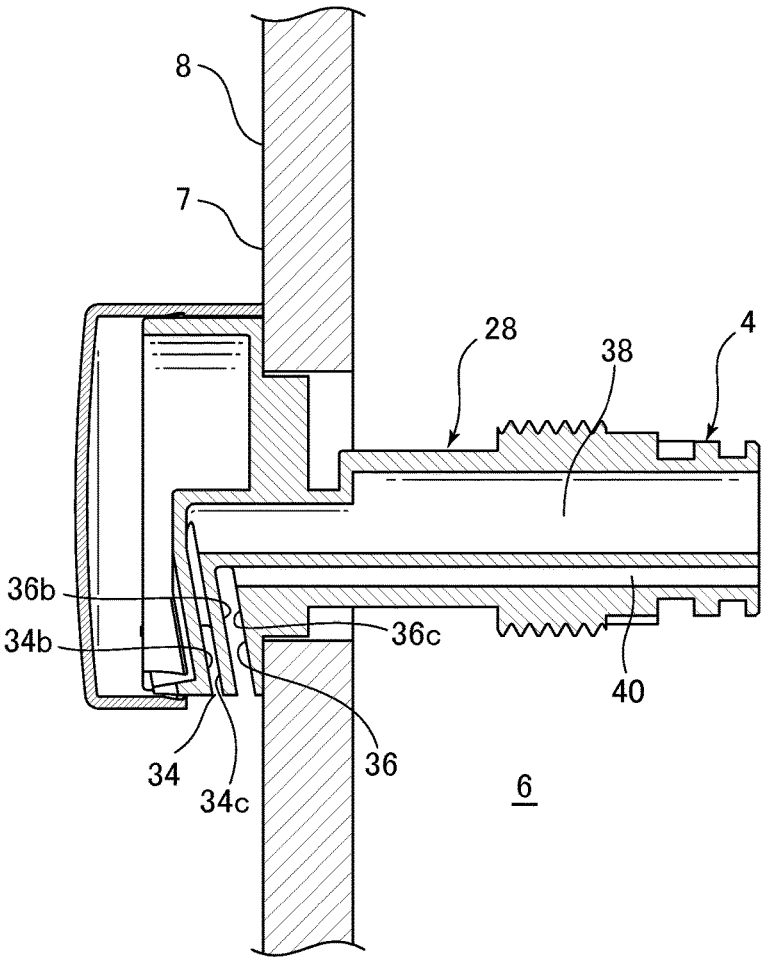
FIG. 7 is a longitudinal section of the urinal according to the embodiment of the present invention at a location slightly leftwardly offset from the center of a transverse line when its spreader is mounted on the bowl surface.
Figure 8:
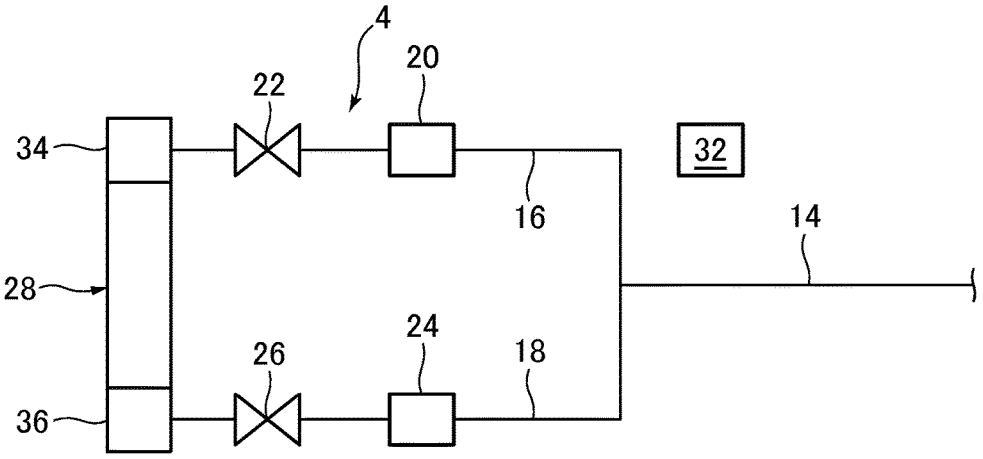
FIG. 8 is a schematic view showing a channeling system in an automatic toilet flushing unit for use with the urinal according to the embodiment of the present invention.
Figure 9:
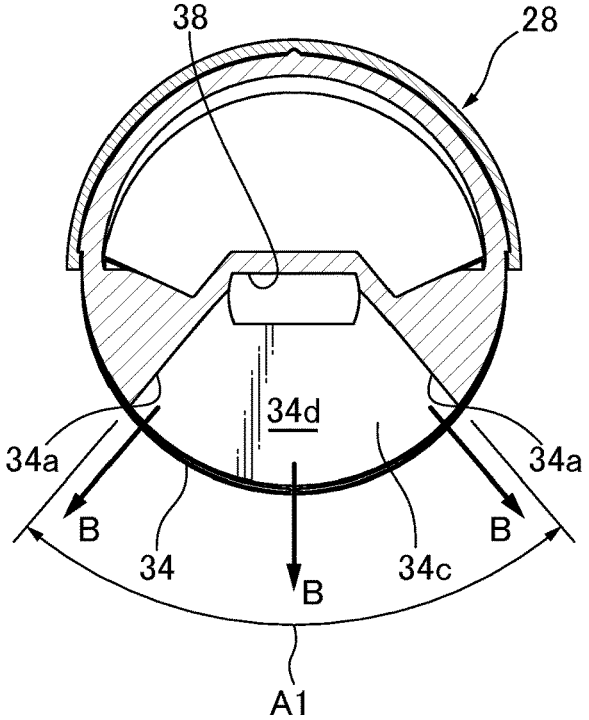
FIG. 9 is a cross-sectional view taken along the line IX-IX in FIG. 6.
Figure 10:
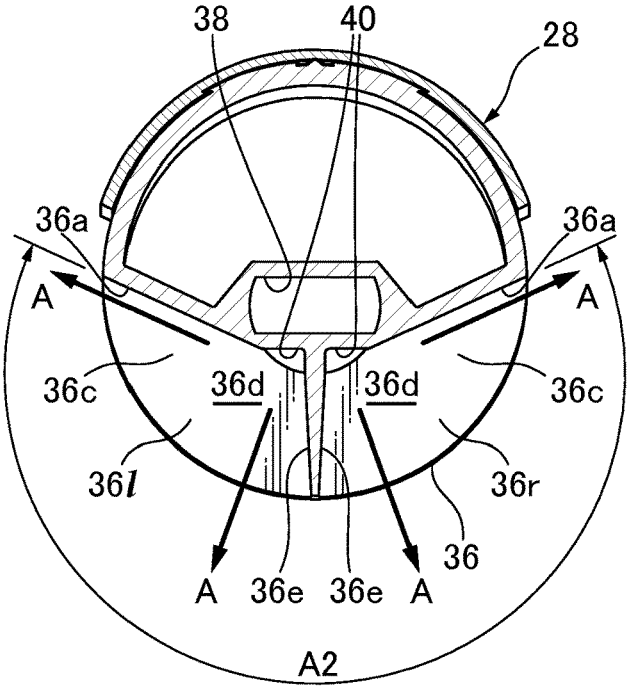
FIG. 10 is a cross-sectional view taken along the line X-X in FIG. 6.

With reference to FIGS. 2 to 10, the automated toilet flushing unit 4 will be described. FIG. 6 is a schematic side view of the urinal according to the embodiment of the present invention with its spreader mounted on a bowl surface of the urinal. FIG. 7 is a longitudinal section of the urinal according to the embodiment of the present invention at a location slightly leftwardly offset from the center of a transverse line with its spreader mounted on the bowl surface. FIG. 8 is a schematic view showing a channeling in an automatic toilet flushing unit of the urinal according to the embodiment of the present invention. FIG. 9 is a cross-sectional view taken along line IX-IX in FIG. 6. FIG. 10 is a cross-sectional view taken along line X-X in FIG. 6. As can be seen from FIGS. 6 and 7, the bowl surface 8 has its bottom slightly sloping backwardly.

The automated toilet flushing unit 4 comprises a main water supply pipe 14 for supplying a flush water from a source such as water supply to the unit 4, first and second water supply pipe 16 and 18 branched off from the main water supply pipe 14, a first flow-controller 20 located in the first water supply pipe 16, a first on-off valve 22 attached to the first water supply pipe 16 for supplying and interrupting the flush water flow, a second flow controller 24 located in the second water supply pipe 18, a second on-off valve 26 attached to the second water supply pipe 18 for supplying and interrupting the flow of the flush water, a spreader 28 connected to the first water supply pipe 16 and second water supply pipe 18 to function as a flush water discharge part, a proximity sensor 30 for detecting the presence of the user and more particularly the human body thereof, and a control unit 32 for controlling the first and second on-off valves 22 and 26 on the basis of the detection signal from the proximity sensor 30, a predetermined control program contained therein and the like.

The first flow control device 20 is a constant flow valve which can regulate the flush water passing through the first water supply pipe 16 to an appropriate constant flow. The first flow control device 20 may be replaced by an alternative device which can use a flow sensor or the like to regulate the flush water to an appropriate flow rate. The first flow control device 20 may be configured to be controlled by the control unit 32. The first flow control device 20 is adapted to regulate the instantaneous flow rate of the flush water supplied to a first downward water supplying passage 38 (which will be described later) to a relatively high range of instantaneous flow rate, e.g., 8-17 L/min, and preferably 11-13 L/min.

The first on-off valve 22 is a solenoid valve which is controlled by the control signal from the control unit 32 to open and close a flow passage defined by the first water supply pipe 16. The first on-off valve 22 may be replaced by an alternative passage opening and closing device for supplying and interrupting the flush water flow.

The second flow control device 24 is a constant flow valve which can regulate the flush water passing through the second water supply pipe 18 to an appropriate constant flow. The second flow control device 24 may be replaced by an alternative device which can use a flow sensor or the like to regulate the flush water to an appropriate flow rate. The second flow control device 24 may be configured to be controlled by the control unit 32. The second flow control device 20 is adapted to regulate the instantaneous flow rate of the discharged flush water supplied to a second downstream water supplying passage 40 (which will be described later) to a relatively high range of instantaneous flow rate, e.g., 2-8 L/min, and preferably 5-7 L/min.

The second on-off valve 26 is a solenoid valve which is controlled by the control signal from the control unit 32 to open and close a flow passage defined by the first water supply pipe 18. The second on-off valve 26 may be replaced by an alternative passage opening and closing device for supplying and interrupting the flush water flow.

In the embodiment shown in FIG. 10, the automated toilet flushing unit 4 comprises a first on-off valve 22 attached to the first water supply pipe 16 for supplying and interrupting the supplied water flow and a second on-off valve 26 attached to the second water supply pipe 18 for delivering and interrupting the supplied water. The control unit 32 controls the first on-off valve 22 to control the supplying and interrupting of the flush water flow to the first water supply passage 38, and controls the second on-off valve 26 to control the supplying and interrupting of the flush water flow to the second water supply passage 40.

Alternatively, however, the automated toilet flushing unit 4 may comprise a switching valve such as a three-way valve which is located at the junction between the main water supply pipe 14 and the water supply pipes 16, 18 in place of the aforementioned first and second on-off valves 22 and 26. More particularly, the control unit 32 controls a switching valve located at the junction between the main water supply pipe 14 and the water supply pipes 16, 18. In this manner, the supplying and interrupting of flush water flow to the first water supply pipe 16 and first water supply passage 38 as well as those to the second water supply pipe 18 and second water supply passage 40 can be controlled independently. Alternatively still, the automated toilet flushing unit 4 may comprise another valve structure which can independently control the supplying and interrupting of flush water flow to the first water supply pipe 16 and first water supply passage 38 as well as the second water supply pipe 18 and second water supply passage 40, in place of the aforementioned first and second on-off valves 22, 26. Alternatively, the automated toilet flushing unit 4 may comprise a combination of the structures, as described above.

The proximity sensor 30 is an infrared sensor for detecting the presence of a user standing in front of the urinal 1 and the distance between the user and the sensor. This proximity sensor 30 permits the control unit 32 to send a control signal when the user moves back to a predetermined distance after he has urinated. In response to this control signal, the second on-off valve 26 is opened to supply the flush water from the second water supply pipe 18 to the spreader 28 for washing the bowl surface 8 of the urinal 1. In this regard, the proximity sensor 30 may be a hidden radio-wave type sensor (microwave sensor) rather than the infrared sensor.

The control unit 32 is configured to send a control signal at each passage of a predetermined time period, e.g., two hours to open the first on-off valve 22 in addition to the control of the second on-off valve 26 based on the detection signal from the proximity sensor 30. In this manner, the flush water is supplied to the spreader 28 from the first water supply pipe 16 for washing the bowl surface 8 of the urinal 1 such that the facility protection washing can be performed by suppressing the breeding of various germs in the drain trap (not shown) and the drainage line (not shown) which are placed downstream of the drain hole 10 and by suppressing the adhesion such as urinary calculi.

With reference now to FIGS. 6 to 10, the structure of the spreader 28 will be described in detail.

As shown in FIG. 6 etc., the spreader 28 of the automated toilet flushing unit 4 is attached to the front face portion 7 of the housing part in the front 8*a* of the urinal body 2.

The spreader 28 comprises a first flush water discharge opening 34 configured in the shape of a sector and adapted to discharge the flush water toward generally to the central region of the bowl surface 8 and in a downwardly divergent flow on the bowl surface, a second flush water discharge opening 36 configured in the shape of a sector and located rearwardly from the first flush water discharge opening 34 and adapted to discharge the flush water in the diagonally upwardly and generally downwardly, and also slightly transversely away from the central bowl region on the bowl surface, a first water supply passage 38 for supplying the flush water to the first flush water discharge opening 34, and a second water supply passage 40 for supplying the flush water to the second flush water discharge opening 36.

The spreader 28 is disposed centrally at the upper region of the bowl surface 8 for discharging in such a manner to spread the flush water from the central region of the bowl surface in the leftward and rightward directions toward the left and right side edges of the bowl surface, respectively.

The first water supply passage 38 is fluidly connected to the end of the first water supply pipe 16 to form a water passage independent of the second water supply passage 40. The first water supply passage 38 supplies the first flow of flush water having a relatively high instantaneous flow rate to the first flush water discharge opening 34. The second water supply passage 40 is fluidly connected to the end of the second water supply pipe 18 to form a water passage independent of the first water supply passage 38. The second water supply passage 40 supplies the second flow of the flush water having a relatively low instantaneous flow rate to the second flush water discharge opening 36.

The first flush water discharge opening 34 comprises opposite upper walls 34*a* forming, respectively, right and left upper ends of the first flush water discharge opening 34, a forward wall 34*b* forming the forward wall face of the first flush water discharge opening 34, and a rearward wall 34*c* forming the rearward wall face of the first flush water discharge opening 34. The first flush water discharge opening 34 defines a first sector-shaped passage 34*d* formed in the downward part of the spreader 28 between the forward and rearward walls 34*a* and 34*c* of the first flush water discharge opening 34 by the right and left upper wall 34*a* of the first flush water discharge opening 34.

The upper walls 34*a* of the first flush water discharge opening 34 is located angularly spaced apart from the vertical centerline of the spreader 28 by about 40 degrees in symmetric manner, respectively. Accordingly, the angle A1 formed between the right and left upper walls 34*a* of the first flush water discharge opening 34 is equal to about 80°. By way of example, the angle A1 formed between the first right and left upper walls 34*a* of the first flush water discharge opening 34 may be preferably such as between 50° and 120° and more preferably between 60° and 90°. In view of the fact that the upper walls 34*a* of the first flush water discharge opening 34 forms the top end of the opening passage 34*d* of the first flush water discharge opening 34, the flush water discharged from the first flush water discharge opening 34 is delivered along the first right and left upper walls 34*a* of the flush water discharge opening 34 such that upward extent of the divergent flow of the discharged flush water can be delimited. Also, in view of the fact that the upper walls 34*a* of the first flush water discharge opening 34 are oriented downwardly from the horizontal plane, the upward extent of the divergent flow of the discharged flush water can be delimited even though the instantaneous flow rate per unit area of the flush water stream discharged from the first flush water discharge opening 34 is increased.

The second flush water discharge opening 36 comprises upper walls 36*a* forming the top end of the second flush water discharge opening 36, a depending wall 36*e* terminating at the central bottom edge of the second flush water discharge opening 36, a forward wall 36*b* forming the forward wall face of the second flush water discharge opening 34, and a rearward wall 34*c* forming the rearward wall face of the second flush water discharge opening 36.

The second flush water discharge opening 36 comprises a second substantially sector-shaped opening passage 36*d* formed in the downward portion of the spreader 28 between the right and left upper walls 36*a* of the second flush water discharge opening 36 by the forward and rearward walls 36*b* and 36*c* of the second flush water discharge opening 36.

Each of the second upper walls 36*a* of the second flush water discharge opening 36 is angularly spaced apart by 115° in a symmetric manner as viewed from the vertical direction corresponding to the depending wall 36*e*, respectively. Accordingly, the angle A2 formed between the second right and left water outlet walls 36*a* is equal to about 230°. By way of example, the angle A2 formed between the upper walls 36*a* of the second flush water discharge opening 36 may be preferably between 190° and 250°, for example and more preferably between 210° and 230°. In view of the fact that the upper walls 36*a* of the second flush water discharge opening forms the top end of the second opening passage 346 of the second flush water discharge opening 36, the flush water discharged from the second flush water discharge opening 36 is delivered along the second right and left water outlet walls 34*a*, such that upward extent of the divergent flow of the discharged flush water can be delimited. Also, in view of the fact that the upper walls 36*a* of the second flush water discharge opening 36 extend upwardly from the horizontal level, upward extent of the divergent flow of the flush water discharged from the second flush water discharge opening 36 and flowing along the second upper walls 36*a* is oriented diagonally upwardly from the spreader 28.

The second flush water discharge opening 36 can deliver the flush water to distribute between the opposite upper walls 36*a* of the second flush water discharge opening 36 so that a water curtain can be formed spreading from the lateral and diagonally upward direction thereof to a place near each of the right and left lateral edges of the bowl surface.

With reference now to FIGS. 1 to 5 and FIGS. 11 to 14, the structure of the urinal body 2 of the urinal 1 will be described in more detail.

Figure 11:
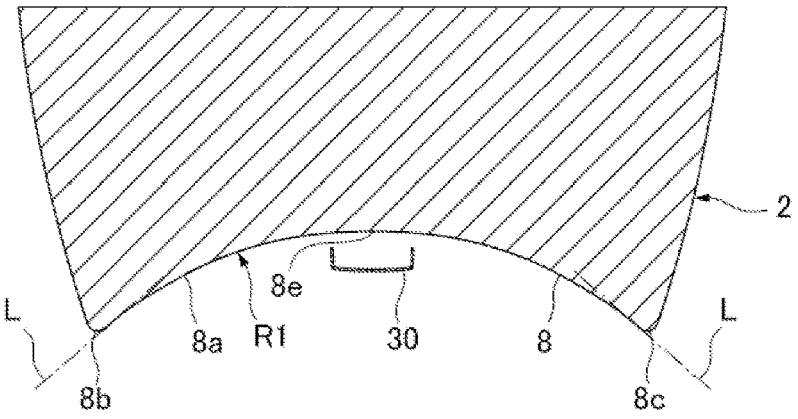
FIG. 11 is a cross-sectional view taken along the line XI-XI in FIG. 2.
Figure 12:
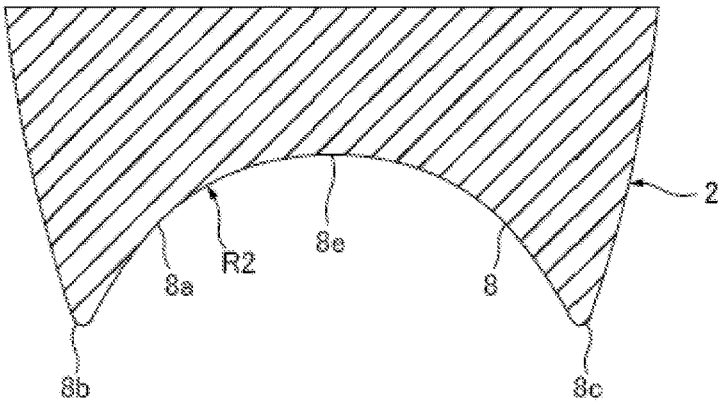
FIG. 12 is a cross-sectional view taken along the line XII-XII in FIG. 2.
Figure 13:
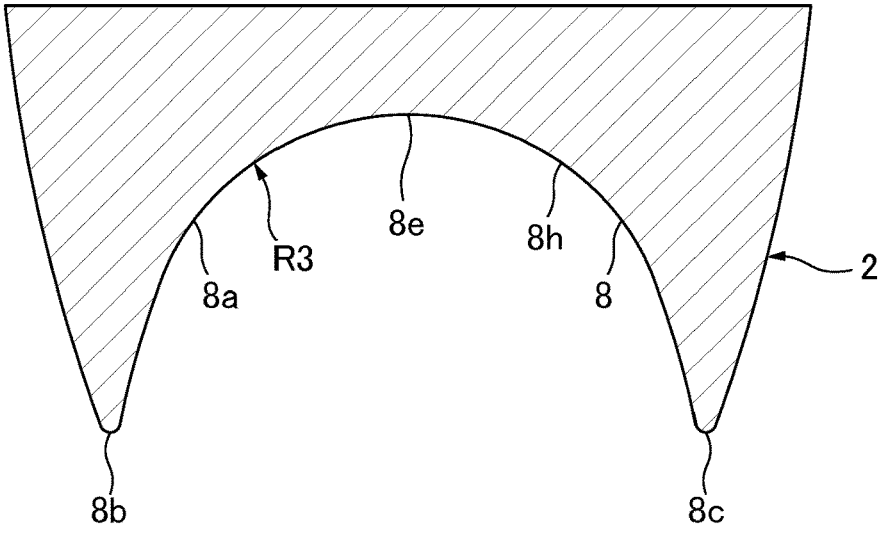
FIG. 13 is a cross-sectional view taken along the line XIII-XIII in FIG. 2.
Figure 14:
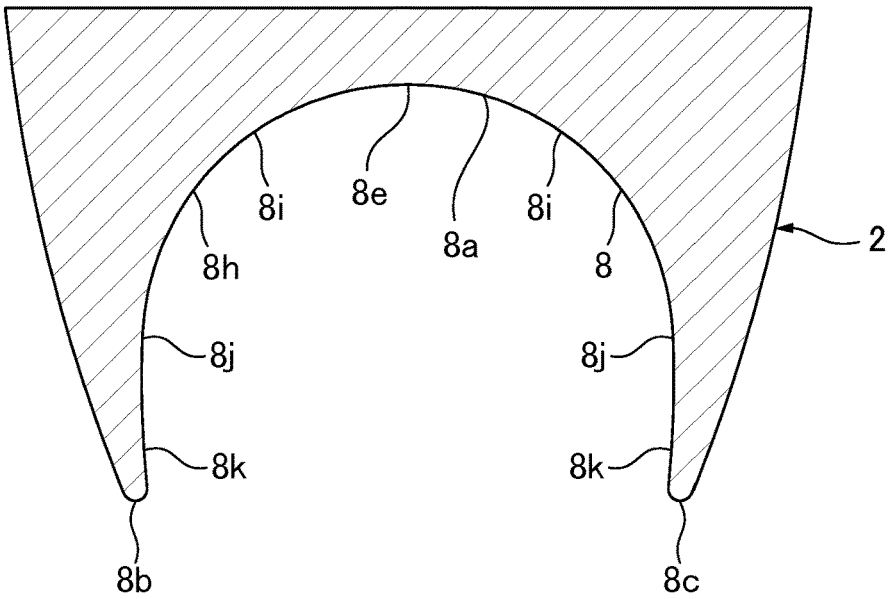
FIG. 14 is a cross-sectional view taken along the line XIV-XIV in FIG. 2.
Figure 15:
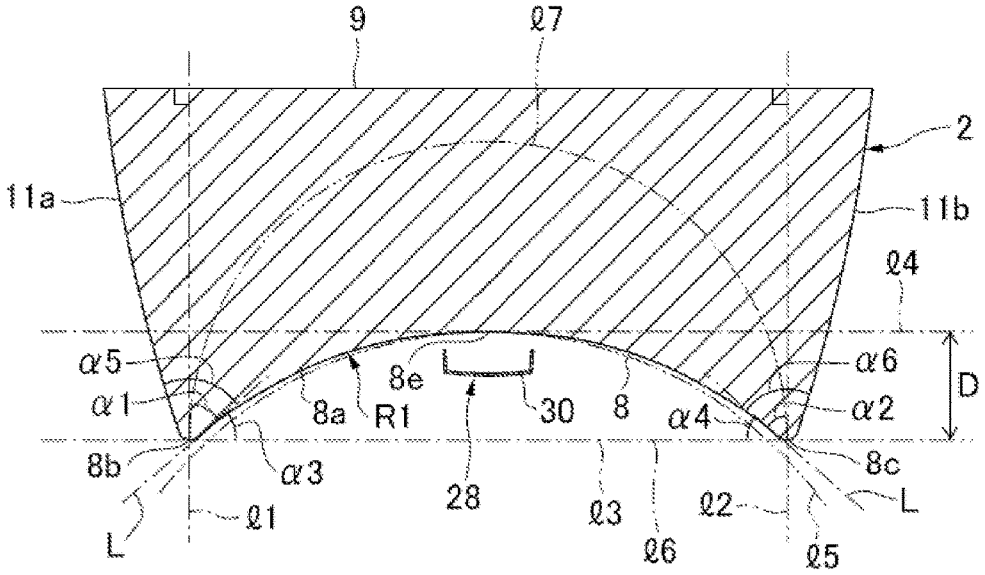
FIG. 15 is a cross-sectional view taken along the line XI-Xi in FIG. 2, illustrating the shape of the front face portion of the bowl surface.

FIG. 11 is a cross-sectional view taken along line XI-XI in FIG. 2. FIG. 12 is a cross-sectional view taken along line XII-XII in FIG. 2. FIG. 13 is a cross-sectional view taken along line XIII-XIII in FIG. 2. FIG. 14 is a cross-sectional view taken along line XIV-XIV in FIG. 2. FIG. 15 is a cross-sectional view taken along the line XI-Xi in FIG. 2, illustrating the shape of the front face portion of the bowl surface.

First of all, it is to be understood that, as shown in FIGS. 2 and 3, the urinal 1 according to this embodiment is of such a type that the automated toilet flushing unit 4 is contained within the housing part chamber 6 located on the top end of the urinal body 2. In this embodiment, the urinal 1 has the front face 7 of the housing part of the urinal body 2, which front face 7 is contiguous with the bowl surface 8 and inclines backwardly. In the urinal body 2, the front face 7 of the housing part (chamber 6) merges with the bowl surface 8. Further, the front face 7 of the housing part of the urinal body is formed to be in a contiguous relationship with the upper side of the bowl surface 8 and to incline backwardly. It is to be noted that the as used therein the term "contiguous" relationship between the front face 7 of the housing part and the bowl surface 8 means that the front face 7 of the housing part including the containing chamber 6 of the urinal body is flush with or substantially flush with the bowl surface 8. In other words, there may not be any appreciable seam between the front face 7 of the housing part and the bowl surface. Additionally, it is not necessarily required that the front face 7 of the housing part including the chamber 6 is completely flush with the bowl surface 8. However, there may be a small step between the front face 7 of the housing part and the bowl surface 8. It is desirable that the flow of the flush water from the front face of the housing part including the containing chamber 6 to the bowl surface 8 will not detach from any surface of the bowl surface.

The bowl surface 8 has at its front a front face portion 8*a* having an arcuate (arch-like) configuration as viewed in the longitudinal section, the front face portion 8*a* opening forwardly from the top to bottom of the bowl surface and facing the user. The bowl surface 8 is formed by only the front face portion 8*a* in an upper region having spreader 28 in the bowl surface which may does not have (may omit) any forwardly projecting plate-like side walls at opposite sides thereof, as in the conventional urinal. Such a front face portion 8*a* may comprise a forwardly facing curved surface, the normal to the tangential line of the curved surface extending toward the user standing in front of the urinal body 2.

The front face portion 8*a* of the bowl surface 8 may be composed of a concavely curved surface which may extend continuously in the leftward/rightward direction. This front face portion 8*a* provides such a curved area conforming to the curvature of the user's body so that it can accommodate the curved body line of the user. The upper region of the urinal 1 defined only by the front face portion 8*a* of the bowl surface 8 is formed along one arc extending from the left side edge 8*b* of the bowl surface 8 to the right side edge 8*c* thereof with a single radius of curvature R (which radius of curvature R will not be substantially varied along its course, i.e., an arc having a radius being called "a single R") as viewed in a plan view, the central part of this arc defining the single R region 8*g* situated rearwardly. In other words, the curved surface in the single R region 8*g* is defined by a substantially single arc configuration having a substantially single radius of curvature R. The single R region 8*g* is defined so that its radius of curvature may gradually decrease and therefore the curvature increase as the bowl surface 8 proceeds downwardly from the top end 8*d* thereof and also the transverse width of the bowl surface 8 may decrease as it proceeds downwardly. The single R region 8*g* of the bowl surface 8 is located at least within an area of a distance of at least 200 mm and more preferably 300 mm from the top end of the bowl surface 8.

The bowl surface 8 also includes a "composite R" region 8*h* disposed below the single R region 8*g* of the bowl surface 8 and defined by a combination of two arcs having different radii of curvature or a combination of an arc with a straight line.

More specifically, as shown in FIG. 11, the front face portion 8*a* of the bowl surface 8 defines in its single R region 8*g*, an arc having a single and greater radius of curvature R1 (=300 mm) at a position spaced apart from the top end 8*d* of the bowl surface 8 by a distance L1 (=150 mm), that is, at a height substantially equal to the forward face 7 of the receiving chamber 6 and the spreader, as viewed in the plan view.

As shown in FIG. 12, the front face portion 8*a* of the bowl surface 8 also defines in its single R region 8*g* an arc having a single radius of curvature being a radius of curvature R2 (=200 mm) smaller than the radius of curvature R1 in the single R area 8*g* at a distance L2 (=300 mm) from the top end 8*d* of the bowl surface 8, as viewed in the plane view.

The radius of curvature of the front face portion 8*a* in the single R region 8*g* may be set within the range of 200-500 mm and preferably 200-400 mm, for example, which could protect the user's arms and hands used to hold the user's penis from contacting with the bowl surface. Therefore, the user can move closer to the urinal when the user urinates. As a result, the user's urine drip after his urinating can be prevented from contaminating the floor.

The front face portion 8*a* of the bowl surface 8 is composed of a concavely curved surface which extends continuously in the leftward/rightward direction so as to guide the flush water in the leftward and rightward directions toward the left and right side edges of the bowl surface 8. The concavely curved surface has a central portion 8*e* which is backed rearwardly at the location of spreader 28 in the center of the concavely curved surface, and left and right side edges 8*b*, 8*c* which situate somewhat forward of the central portion 8*e*, thus resulting in the formation of a curved surface continuously extending along an arc.

As shown in FIG. 15, the bowl surface 8 is arranged so as to situate between a line segment 16 connecting the left and right side edges 8*b*, 8*c* and an arcuate segment 17 of a circle having a diameter corresponding to the line segment 16, as viewed in the horizontal section through the spreader 28. The bowl surface 8 has its cross-sectional profile which can be configured as appropriate in the range between the line segment 16 connecting the left and right side edges 8*b*, 8*c* of the bowl surface 8, and an arcuate segment 17.

Also, as shown in FIG. 15, as viewed in the horizontal section through the spreader 28, the bowl surface 8 is arranged such that an angle α1 formed between a normal l1 drawn at a perpendicular angle from the left side edge 8*b* to a wall-mounting surface 9 provided at the back of the urinal 1 (the urinal of the present invention can applied to a floor-standing flush toilet while the surface 9 of the urinal 1 is referred to as a "wall-mounting surface" of the urinal when it is not mounted on any wall.) and the front face portion 8*a* (for example, the line L tangent to each of the side edges of the front face portion 8*a*) is greater than 45° and smaller than 90°. Likewise, the bowl surface 8 is arranged such that an angle α2 formed between a normal l2 drawn at a perpendicular angle from the right side edge 8*c* to the wall-mounting surface 9 and the front face portion 8*a* (for example, the line L tangent to each of the side edges of the front face portion 8*a*) is greater than 45° and smaller than 90°. Accordingly, an angle α3 formed between an imaginary line l3 (line segment l6) connecting the left and right side edges 8*b*, 8*c* in the vicinity of the left side edge 8*b* of the bowl surface, as viewed in the horizontal section through the spreader 28 and the front face portion 8*a* of the bowl surface 8 (for example, the line L tangent to each of the side edges of the front face portion 8*a*) is greater than 0° and smaller than 60°, and preferably equal to or greater than 10° and equal to or smaller than 45°. Further, an angle α4 formed between an imaginary line l3 (line segment l6) connecting the left and right side edges 8*b*, 8*c* in the vicinity of the right side edge 8*c* of the bowl surface, as viewed in the horizontal section through the spreader 28 and the front face portion 8*a* of the bowl surface 8 (for example, the line L tangent to each of the side edges of the front face portion 8*a*) is greater than 0° and smaller than 60°, and preferably equal to or greater than 10° and equal to or smaller than 45°.

In the horizontal section through the spreader 28, the bowl surface 8 has its depth, i.e., a depth D equal to a distance from the left and right side edges 8*b*, 8*c* to the central portion 8*e* on which the spreader 28 is located, which depth is within the range from 40 mm to 55 mm. Thus, the front face portion 8*a* of the bowl surface 8 in the vicinity of the spreader is configured so that the forward/backward distance between the left and right side edges 8*b*, 8*c* and the central portion 8*e* is within the range from 40 mm to 55 mm. The front face portion 8*a* can be configured so that the forward/backward distance between the left and right side edges 8*b*, 8*c* and the central portion 8*e* is comparatively shorter. In this way, the front face portion 8*a* can be configured to have a concavely curved surface having a relatively shallow depth.

Also, the bowl surface 8 is arranged such that an angle α5 formed between the front face portion 8*a* (for example, the line L tangent to the left and right side edges of the front face portion 8*a*) and a bowl left side wall 11*a* (for example, the line tangent to the bowl left side wall 11*a*) as viewed in the horizontal section through the spreader 28 may be within the range from 30° to 80°. Likewise, the bowl surface 8 is arranged such that an angle α6 formed between the front face portion 8*a* (for example, the line L tangent to the left and right side edges of the front face portion 8*a*) and a bowl right side wall 11*b* (for example, the line tangent to the bowl right side wall 11*b*) may be within the range from 30° to 80°. By selectively determining the angle between the front face portion 8*a* of the bowl surface 8 and the bowl left and right side walls 11*a*, 11*b*, the front face portion 8*a* can be arranged to define a face which extends relatively transversely relative to the back wall surface of the bowl and faces forwardly. The bowl left and right side walls 11*a*, 11*b* can extend in a divergent manner which the back side portions become wide backwardly as viewed in a direction from front to back of the urinal. Alternatively, the bowl left and right side walls 11*a*, 11*b* can be parallel. Also, the bowl left and right side walls 11*a*, 11*b* extend in a convergent manner which the back side portions become narrow backwardly as viewed in a direction from front to back of the urinal. The bowl left and right side walls 11*a*, 11*b* can each have a rounder outer profile.

The bowl surface 8 is configured so that the single radius of curvature of the bowl surface 8*a* of the bowl surface 8, as viewed in the horizontal section through the spreader 28 is within a range from 150 mm to 500 mm and preferably, for example, a range from 200 mm to 500 mm and most preferably, a range from 150 mm 450 mm.

The bowl surface 8 can define a curved surface having a predetermined radius of curvature such that the front face portion 8*a* of the bowl surface 8 is located between the imaginary line l4 extending horizontally at a level of the spreader 28 and a certain imaginary arcuate line l5 which is tangent to the imaginary line l4 extending horizontally at a level of the spreader 28, as viewed in the horizontal section through the spreader 28. The imaginary arcuate line l5 corresponds to an arcuate segment or the like having a radius of curvature of 80 mm to 200 mm, for example 90 mm.

The front face portion 8*a* of the bowl surface 8 defines in its composite R region 8*h* a composite circular arc comprising a combination of two circular arc portions having two radii of curvature at a distance L3 (=450 mm) from the top end 8*d* of the bowl surface 8, as viewed in the plan view.

The bowl surface 8 also comprises, in the lower composite R region 8*h*, forwardly extending left and right side edges 8*b*, 8*c* and a central, rearwardly extending section 8*e*. The bowl surface 8 further comprises an arcuate portion 8*i* (front face portion 8*a*) opening toward the standing user and rectilinear portions 8*j* (side faces 8*k*) forwardly extending toward the standing user by his sides, these portions being formed, for example, at a distance L4 (=500 mm) from the top end 8*d* of the bowl surface 8, as view in a plan view.

The bowl surface 8 further comprises opposite side portions 8*k* provided on the front face portion 8*a* at its opposite sides and projecting forwardly at a region lower than the distance L4 from the top end 8*d*, in addition to the front face portion 8*a*.

As can be seen from FIG. 11, the bowl surface 8 comprises at the height of the top end and particularly at the height of the single R region 8*g* (e.g., the height of the region near the spreader 28), an outwardly oriented tangential line L defined in the vicinity of the left side edge 8*b* of the bowl surface 8 in the front side and also an oppositely outwardly-oriented tangential line L defined in the vicinity of the right side edge 8*c* of the bowl surface 8 in the front side, as viewed in the horizontal section.

In the horizontal section, the left and right side edges 8*b*, 8*c* of the bowl surface 8 are configured to project forwardly from the central section 8*e*. The left and right side edges 8*b*, 8*c* of the bowl surface 8 are configured to project forwardly in a gradual manner as they proceed to the lower portion of the bowl surface 8. Since the left and right side edges 8*b*, 8*c* of the bowl surface 8 are arranged to project forwardly from the central section 8*e*, it is advantageous that the penis of the user using the urinal 1 can be hidden from surroundings (e.g., another user of an adjacent urinal).

The front face portion 8*a* of the bowl surface 8 is configured to incline downwardly and rearwardly from the top end 8*d* of the bowl surface 8. Accordingly, the central portion 8*e* of the front face portion 8*a* is backed (recessed) gradually rearwardly and downwardly from the top end 8*d*.

The spreader 28 is positioned slightly backwardly from the central portion 8*e*. Therefore, the user can move closer to the front face portion 8*a* with little difficulty.

The left and right side edges 8*b*, 8*c* of the bowl surface 8 at their lower portions project forwardly toward a tip 8*f* of the bowl surface 8. In the upper region of the bowl surface 8, the user can easily move closer to the bowl surface 8 while the tip 8*f* of the bowl surface 8 is arranged to project toward the user. Accordingly, the urine drip after urinating can be prevented from contaminating the floor. The lower portion of the bowl surface 8 is formed to collect the flowing-down flush water into the drain hole 10.

Operation of the urinal according to the embodiment of the present invention will now be described.

First of all, the process of the urine cleaning operation of the urinal 1 according to the embodiment of the present invention will be described.

Usually, the proximity sensor 30 detects a user which stands in front of the urinal 1 and sends the detection information to the control unit 32. In such a manner, the control unit 32 recognizes the presence of the user. When the user finishes his urination to the bowl surface 8 of the urinal 1 and leaves the urinal 1, the proximity sensor 30 changes to the non-detection state. The control unit 32 then determines that the user has left the urinal 1 and starts a urine cleaning operation.

In the urine cleaning operation, the control unit 32 sends a control signal to the second on-off valve 26 to open it, thereby supplying the flush water from the main water supply pipe 14 to the second water supply passage 40 through the second water supply pipe 18. At this time, the instantaneous flow rate per unit area of the flow of the flush water supplied to the second water supply passage 40 is adjusted by the second flow control device 24 to the relatively low extent of instantaneous flow rate as described above. As will be described later, first and second the flush water portions of different instantaneous flow rates will be supplied from one main water supply pipe 14 to the bowl surface 8 through the first and second water supply pipes 16, 18. The flush water supplied to the second water supply passage 40 collides with the forward wall 36*b* of the second flush water discharge opening 36 so that the flow of the flush water will be spread between the left and right upper walls 36*a*. The flush water discharged from the second flush water discharge opening 36 is spread upwardly in the transverse direction between the left and right upper walls 36*a*. The flush water is further discharged from the second flush water discharge opening 36 to spread rearwardly toward the bowl surface 8 through between the forward and rearward walls 36*b*, 36*c* of the second flush water discharge opening 36. FIGS. 1 and 12 show the flow of the flush water discharged from the second flush water discharge opening 36 by arrow A. As described above, the flush water flow provided in the upper area of the second flush water discharge opening 36 is directed diagonally upwardly on each side of the centerline thereof along the divergent upper walls 36*a*, which incline upwardly from the horizontal direction.

Since the angle formed between the left and right upper walls 36*a* of the second flush water discharge opening 36 is relatively greater, the flush water discharged from the second flush water discharge opening 36 is spread widely from the right and left upper portions of the bowl surface 8 to the central lower portion of the bowl surface 8. The flush water discharged from the second flush water discharge opening 36 can wash or clean widely the left and right upward regions of the bowl surface 8 around the spreader 28 as well as the wider area between the central region and the side regions. At this time, the flush water discharged from the second flush water discharge opening 36 flows down from the top end 8*d* along the front face portion 8*a* of bowl surface 8 which inclines rearwardly and downwardly, such that the velocity of the flush water flowing slantingly and upwardly in the transverse direction is reduced. Accordingly, the lateral spreading of the flush water can be restrained to prevent the flush water from running off the opposite side edges of the bowl surface 8. Since the flush water discharged from the second flush water discharge opening 36 has its relatively low instantaneous flow rate, the flush water can wash the bowl surface near to both the opposite sides of the bowl surface 8. On the other hand, the flush water discharged from the second flush water discharge opening 36 will not run off the opposite side edges of the bowl surface 8 and can flow therealong while washing areas in the vicinity of the left and right side edges 8*b*, 8*c* of the bowl surface 8.

In such a manner, the flush water being discharged from the spreader 28 can be guided from the central portion of the bowl surface 8 in the leftward and rightward directions toward the left and right side edges 8*b*, 8*c* of the bowl surface 8 to thereby reach areas in the vicinity of the left and right side edges 8*b*, 8*c* of the bowl surface 8 and wash the areas in the vicinity of the left and right side edges 8*b*, 8*c* of the bowl surface 8, thus providing cleaning of a wider part of the bowl surface 8 than in the prior art.

In such a manner, the flush water being discharged from the second flush water discharge opening 36 of spreader 28 flows and spreads widely over the bowl surface 8 in the radial direction from the spreader 28 so that the bowl surface 8 can be effectively washed and cleaned. The flush water flowing down from the bowl surface 8 is drained through the drain hole 10 into the downstream drain trap line (not shown) and into the downstream drain pipe (not shown).

When the flush water flow having the predetermined instantaneous flow rate is discharged from the second flush water discharge opening 36 of the spreader 28, the control unit 32 closes the second on-off valve 26 and stops the discharging of flush water from the spreader 28. Thus, the urine cleaning operation will be completed.

The process of a facility protecting and cleaning operation by the urinal 1 according to the embodiment of the present invention will now be described.

The control unit 32 performs a facility protecting and cleaning operation in addition to the urine washing operation.

The control unit 32 starts the facility protecting and cleaning operation under such conditions that a constant time period has elapsed after the last facility protecting and cleaning operation has been performed (e.g., after two hours after the previous facility protecting and cleaning operation has been performed), that the usage count of the urinal 1 has reached a constant number of times for a fixed period of time and so on.

In the facility protecting and cleaning operation, the control unit 32 sends a control signal to the first on-off valve 22 and thus opens the first on-off valve 22 such that the flush water supplied from the main water supply pipe 14 is supplied to the first water supply passage 38 through the first water supply pipe 16. At this time, the instantaneous flow rate of the flush water supplied to the first water supply passage 38 is adjusted by the first flow control device 20 to the aforementioned relatively high extent of instantaneous flow rate. FIGS. 1 and 11 show the flow of the flush water discharged from the first flush water discharge opening 34 by arrow B. Since the angle formed between the left and right upper walls 34*a* of the first flush water discharge opening 34 is relatively small, the flush water discharged from the first flush water discharge opening 34 is spread into a relatively narrow range at a position near to the central portion of the bowl surface 8. Accordingly, the flush water discharged from the first flush water discharge opening 34 has a relatively high instantaneous flow rate, but it will not run off either of the left- and right side edges 8*b*, 8*c* of the bowl surface 8. As a result, the flow of the flush water washes and cleans the regions about the central portion of the bowl surface 8 while moving downwardly. In such a manner, the flush water having a relatively high instantaneous flow rate discharged from the first flush water discharge opening 34 can flow into the drain hole 10. Since the flush water having a relatively high instantaneous flow rate passes through the drain trap line (not shown) downstream of the drain hole 10 and further moves into the downstream drain pipe (not shown), the level of the flush water will be increased and flow while washing and cleaning the drain trap line and drain pipe. Accordingly, the urine and foreign matters such as pubic hairs and urinary calculus within these pipes or tubes can be washed and removed to suppress bacteriologic breeding and the adhesion (occurrence) of the urinary calculus.

Advantageous effects obtained by the urinal according to the embodiment of the present invention will now be described.

In the urinal 1 according to the embodiment of the present invention as described above, the upper region of the bowl surface 8 on which the spreader 28 is provided is only defined by the front face portion 8*a* which faces the user and which includes a concavely curved surface which extends continuously in the leftward/rightward direction and has its single radius of curvature, the front face portion 8*a* being devoid of any forwardly projecting side walls at opposite sides thereof. Therefore, the user can move close to the urinal when the user urinates. As a result, the urine drip after urinating can be prevented from contaminating the floor and the user may be avoided from feeling uncomfortable.

Repeatedly speaking, since the upper region of the bowl surface 8 on which the spreader 28 is provided is defined by of the front face portion 8*a* facing the user that includes the concavely curved surface which extends continuously in the leftward/rightward direction and has its single radius of curvature, the front face portion 8*a* of the bowl surface 8 also being free of any forwardly projecting side walls at opposite sides thereof that may provide portions which could be difficult to clean, the cleanliness of the bowl surface 8 can be improved.

Additionally, the front face portion 8*a* having the concavely curved surface which extends continuously in the leftward/rightward direction and has its radius of curvature can prevent the flush water discharged from the spreader 28 toward the sides of the bowl surface 8 from running off the opposite sides of the bowl surface 8.

In the urinal 1 according to the embodiment of the present invention, the flush water discharged to spread in the leftward/rightward direction and upwardly can flow downwardly on the front face portion 8*a* of the bowl surface 8 which is inclined downwardly and rearwardly. Accordingly, the velocity the flush water flowing in the leftward/rightward direction and upwardly can be reduced to limit the horizontal spread of the flush water. This can prevent the flush water from being splattered out of the bowl surface 8. In such a manner, the present invention can flush and clean the wider part of the bowl surface 8 and also can prevent the externally splattering of the flush water.

In the urinal 1 according to the embodiment of the present invention, additionally, the front face portion 8*a* is configured to gradually back as the bowl surface 8 extends downwardly from the upper end 8*d* thereof and has its decreasing radius of curvature. As a result, the transverse width of the bowl surface 8 may decrease as it proceeds downwardly. Therefore, the user can move closer to the bowl surface 8 by comparison with the conventional urinals. Accordingly, the urine drip after urinating can be prevented from contaminating the floor and the user may be avoided from feeling uncomfortable.

Additionally, such arrangement in which the bowl surface 8 extends downwardly from the top end 8*d* thereof and has its decreasing radius of curvature can screen the penis of the user from other surrounding persons.

In the urinal 1 according to the embodiment of the present invention, an urine splash to the outside of the bowl surface 8 can be prevented more reliably in the lower part of the bowl surface 8 on which the user's urine is prone to impinge.

Furthermore, the penis of the user can be screened against view of other surrounding persons since both the sides 8*b*, 8*c* of the bowl surface 8 are formed to extend forwardly.

In the urinal 1 according to the embodiment of the present invention, the upper region of the front bowl face 8*a* without any vertical side walls is situated within the range of at least 200 mm measured from top end 8*d* of the bowl surface 8. As a result, the user's hand or arm holding the penis of the user will not come to contact with the side walls of the bowl surface as in the prior art. Consequently, the user can moves closer to the front face portion 8*a* of the bowl surface 8 of the urinal by comparison with the prior art urinal.

In the urinal 1 according to the embodiment of the present invention, the front face portion 8*a* in the upper region of the bowl surface 8 is configured so that tangent lines L defined in the vicinity of the left and right side edges 8*b*, 8*c* of the bowl surface 8 forwardly extend outwardly in a divergent manner, as viewed in the horizontal section. Accordingly, the user can move closer to the front face portion 8*a* of the bowl surface 8 without contacting with the opposite sides 8*b*, 8*c* of the bowl surface 8.

Also, in the urinal 1 according to the embodiment of the present invention, the bowl surface 8 is arranged so as to situate between a line segment l6 connecting the left and right side edges (the left side edge 8*b* and the right side edge 8*c*) and an arcuate segment l7 of a circle having a diameter corresponding to the line segment l6, as viewed in the horizontal section through the spreader 28. Accordingly, the bowl surface 8 is arranged to spread the flush water being discharged from the spreader 28 provided on the bowl surface centrally at its upper region, on the bowl surface 8 in the leftward and rightward directions toward the left and right side edges (the left side edge 8*b* and the right side edge 8*c*) of the bowl surface 8. As can be seen, the bowl surface 8 is devoid of any forwardly projecting side walls at its opposite sides thereof as in the prior art that can produce the area which is difficult to clean by means of the flush water. In the urinal 1 of the present invention, the flush water is discharged in such a manner to spread in the leftward and rightward directions and reach an area in the vicinity of each of left and right side edges of the bowl surface to thereby flush and clean a wider part of the bowl surface 8 than in the prior art as well as reduce an area of the bowl surface 8 that is not cleaned by the flush water and provide an improved cleanliness and sanitation of the bowl surface 8.

In the urinal 1 according to the embodiment of the present invention, the bowl surface 8 is configured so that an angle α3 between the line segment connecting the left and right side edges (the left side edge 8*b* and the right side edge 8*c*) of the bowl surface 8 and each of tangent lines L defined at the left and right side edges of the bowl surface is greater than 0° and equal to or smaller than 60°, as viewed in the horizontal section through the spreader 28. Accordingly, the bowl surface 8 is arranged to spread the flush water being discharged from the spreader 28 provided on the bowl surface 8 centrally at its upper region, on the bowl surface 8 in the leftward and rightward directions toward the left and right side edges (the left side edge 8*b* and the right side edge 8*c*) of the bowl surface 8. As can be seen, the bowl surface is devoid of any forwardly projecting side walls at its opposite sides thereof as in the prior art that can produce the area which is difficult to clean by means of the flush water. In the urinal 1 of the present invention, the flush water is adapted to spread and reach an area in the vicinity of each of left and right side edges of the bowl surface 8 to thereby flush and clean a wider part of the bowl surface than in the prior art as well as reduce an area of the bowl surface 8 that is not cleaned by the flush water and provide an improved cleanliness and sanitation of the bowl surface 8.

In the urinal 1 according to the embodiment of the present invention, the bowl surface 8 is configured so that an angle α3 between the line segment connecting the left and right side edges (the left side edge 8*b* and the right side edge 8*c*) of the bowl surface 8 and each of tangent lines L defined at the left and right side edges of the bowl surface is greater than 0° and equal to or smaller than 45°, as viewed in the horizontal section through the spreader 28. Accordingly, the bowl surface 8 is arranged to spread the flush water being discharged from the spreader 28 provided on the bowl surface 8 centrally at its upper region, on the bowl surface 8 in the leftward and rightward directions toward the left and right side edges (the left side edge 8*b* and the right side edge 8*c*) of the bowl surface 8. As can be seen, the bowl surface is devoid of any forwardly projecting side walls at its opposite sides thereof as in the prior art that can produce the area which is difficult to clean by means of the flush water. In the urinal 1 of the present invention, the flush water is adapted to spread and reach an area in the vicinity of each of left and right side edges of the bowl surface 8 to thereby flush and clean a wider part of the bowl surface than in the prior art as well as reduce an area of the bowl surface 8 that is not cleaned by the flush water and provide an improved cleanliness and sanitation of the bowl surface 8.

In the urinal 1 according to the embodiment of the present invention, the bowl surface 8 has its depth as viewed in the horizontal section through the spreader 28, i.e., a shallow depth equal to a distance from the left and right side edges (the left side edge 8*b* and the right side edge 8*c*) to the level of the spreader 28 located at the center of the concavely curved surface, which depth is within the range from 40 mm to 55 mm. Accordingly, the bowl surface 8 is arranged to easily spread the flush water being discharged from the spreader 28 provided on the bowl surface 8 centrally at its upper region, in the leftward and rightward directions toward the left and right side edges of the bowl surface 8.

Also, in the urinal 1 according to the embodiment of the present invention, since the bowl surface 8 is arranged so that the single radius of curvature of the bowl surface 8, as viewed in the horizontal section through the spreader 28 is within the range from 200 mm to 500 mm and level of the spreader 28 corresponds to a shallow depth of the bowl surface, it is possible to easily guide the flush water being discharged from the spreader 28 provided on the bowl surface 8 centrally at its upper region, on the bowl surface 8 in the leftward and rightward directions toward the left and right side edges of the bowl surface 8. As can be seen, the bowl surface is devoid of any forwardly projecting side walls at its opposite sides thereof as in the prior art that can produce the area which is difficult to clean by means of the flush water. The flush water is discharged in such a manner to spread in the leftward and rightward directions and reach an area in the vicinity of each of left and right side edges of the bowl surface 8 to thereby flush and clean a wider part of the bowl surface than in the prior art as well as reduce an area of the bowl surface 8 that is not cleaned by the flush water.

Also, in the urinal 1 according to the embodiment of the present invention, the bowl surface 8 is configured to have a radius of curvature of the concavely curved surface, as viewed in the horizontal section that continuously decreases downwardly from the top end of the bowl surface 8, the transverse width of the bowl surface may decrease as it proceeds downwardly. Therefore, the user can move closer to the bowl surface by comparison with the conventional urinals. Accordingly, the urine drip after urinating can be prevented from contaminating the floor and the user may be avoided from feeling uncomfortable.

Also, the arrangement in which the bowl surface 8 is configured to have a radius of curvature of the concavely curved surface, as viewed in the horizontal section that continuously decreases downwardly from the top end of the bowl surface, can screen the penis of the user from other surrounding persons.

Next, a urinal according to a second embodiment of the present invention will be described as shown in FIGS. 16-19. The urinal system according to the second embodiment of the present invention is similar to the urinal system according to the first embodiment of the present invention except for the provision of a ledge 142 and a modified spreader 128 provided on the bowl surface 8. Only differences between the first and second embodiments of the urinal of the present invention will be described below. The same components of the second embodiment as the first embodiment are designated by the same reference numerals and will not be further described.

Figure 16:
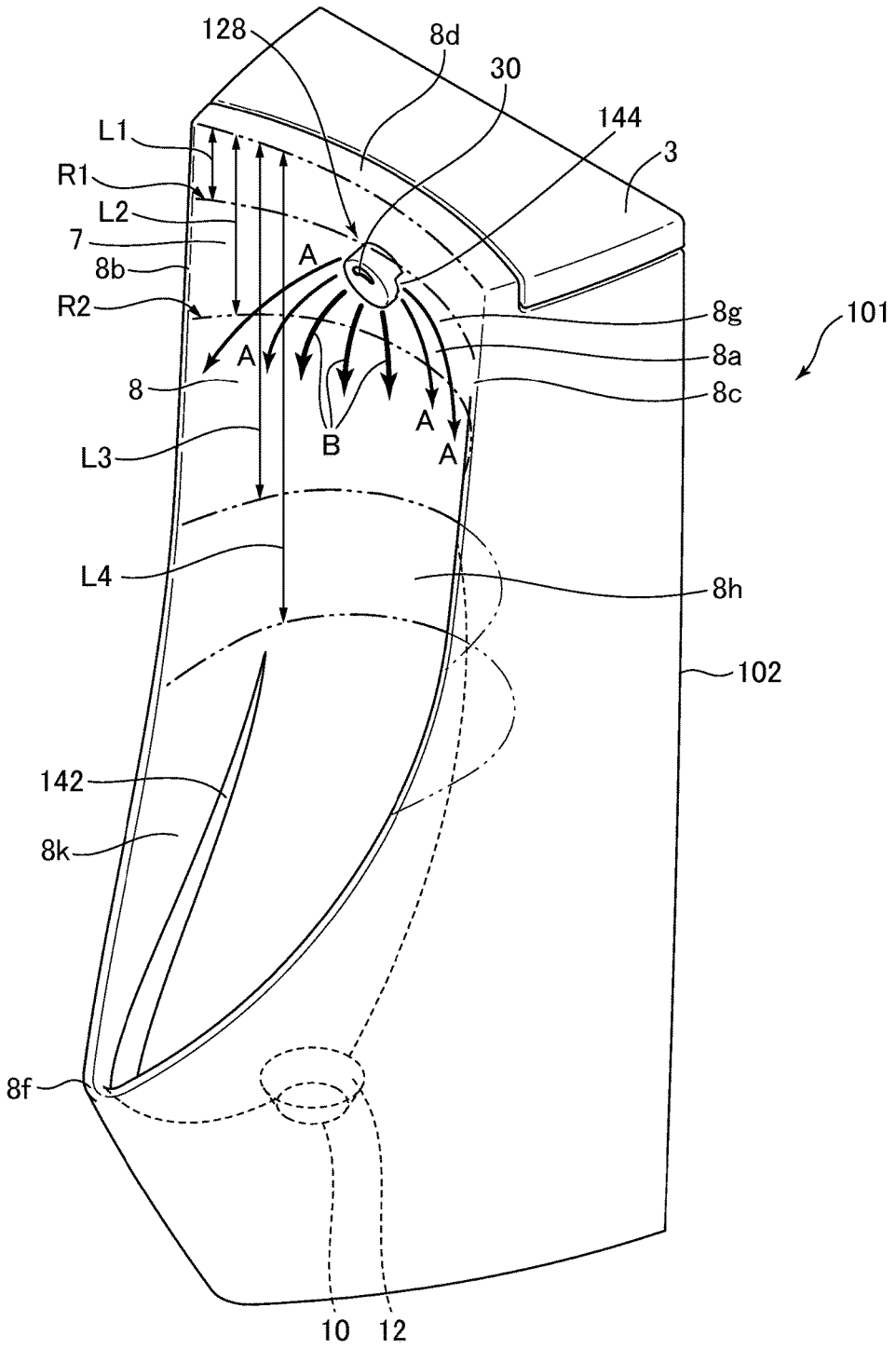
FIG. 16 is a perspective view showing, as a whole, a urinal according to a second embodiment of the present invention.
Figure 17:
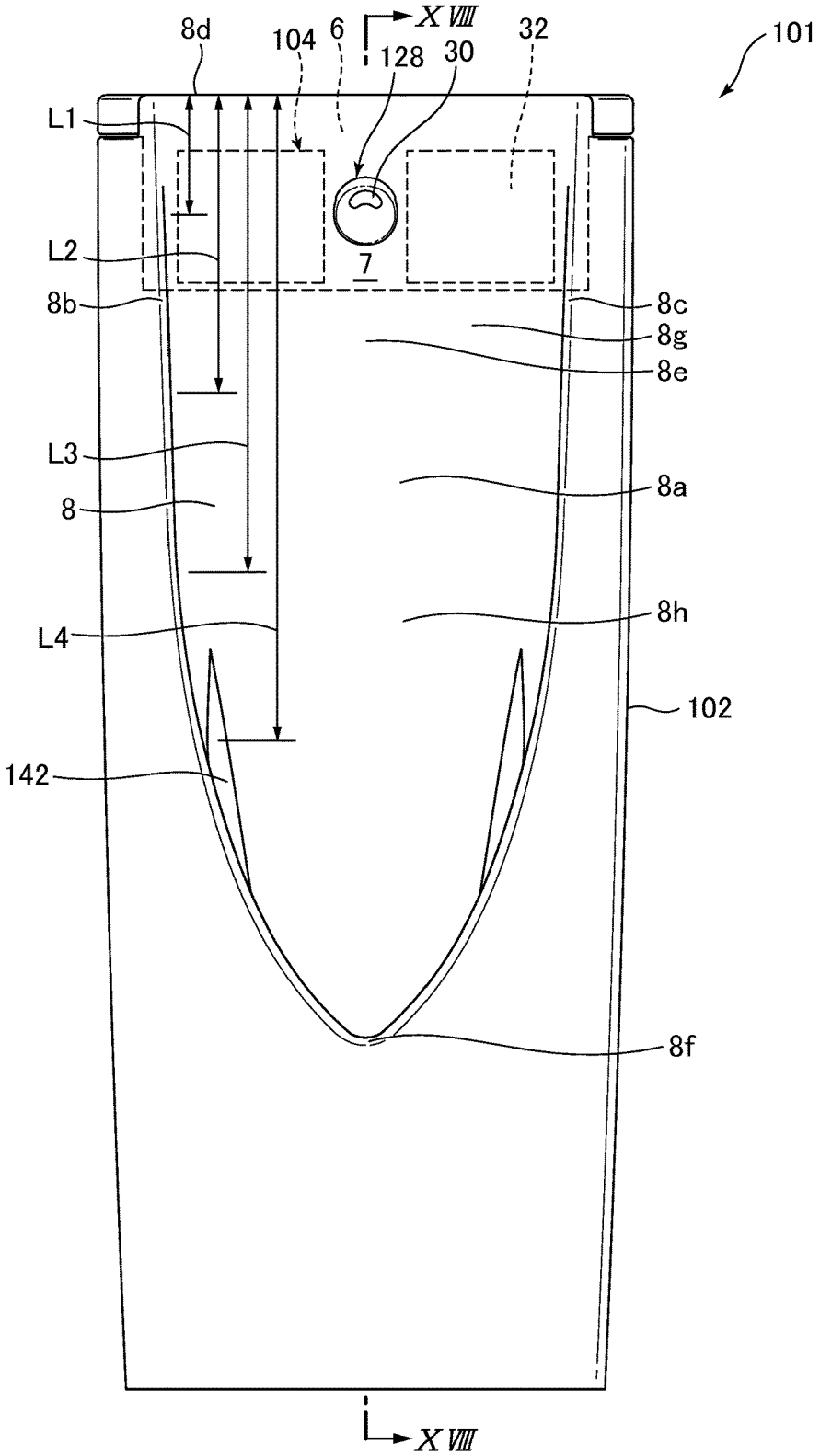
FIG. 17 is a front view of the urinal shown in FIG. 16.
Figure 18:
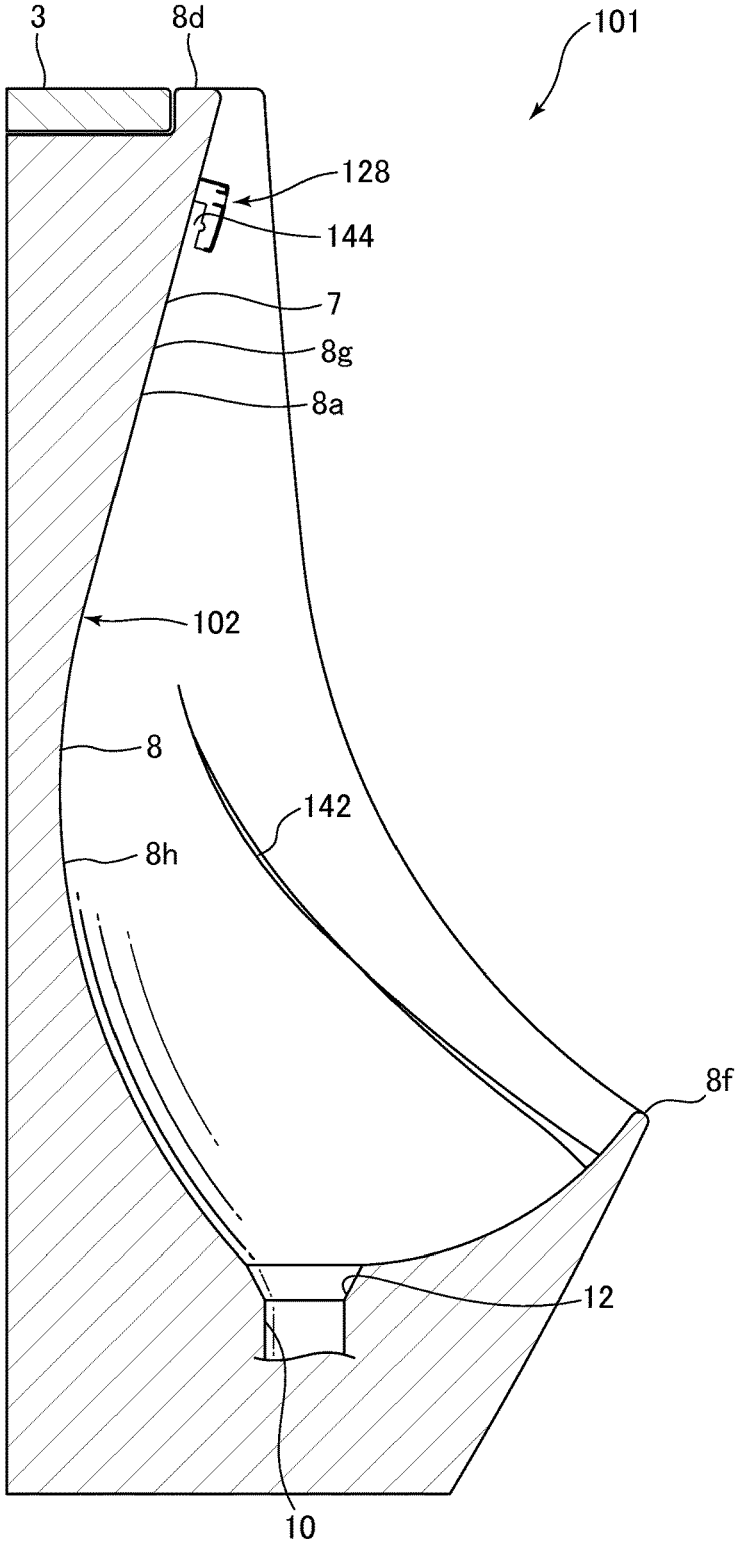
FIG. 18 is a longitudinal section of the urinal taken along the line XVIII-XVIII in FIG. 17
Figure 19:
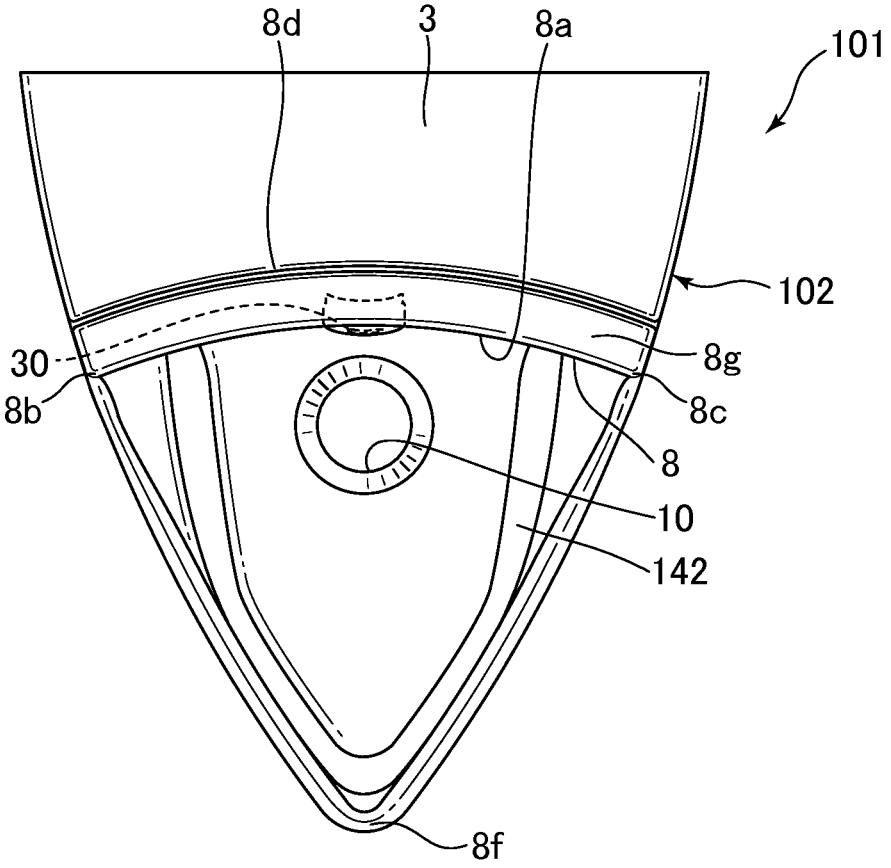
FIG. 19 is a plan view of the urinal shown in FIG. 16.

FIG. 16 is a perspective view showing, as a whole, a urinal according to a second embodiment of the present invention, FIG. 17 is a front view of the urinal shown in FIG. 16, FIG. 18 is a longitudinal section of the urinal taken along the line XVIII-XVIII in FIG. 17, and FIG. 19 is a plan view of the urinal shown in FIG. 16.

In the urinal 101 according to the second embodiment of the present invention, the bowl surface 8 includes a ledge 142 extending downwardly from left and right sides of the bowl surface 8 to forward side. The ledge sections of the ledge 142 are adapted to guide forwardly thereon a portion of the flush water spreading on the bowl surface 8. The ledge sections of the ledge 142 can be formed downwardly of a location near the middle height of the bowl surface 8 for example, extends downwardly from opposite linear portions 8*j* (or side surfaces 8*k*) which define opposite inward surfaces in the composite R region 8*h* toward the tip 8*f*. The ledge sections of the ledge 142 project transversely inward of the bowl 8 and each define an upper flat surface on which the flush water easily flow so as to guide on the ledge 142. Due to the presence of the ledge 142, it is possible to flow a reduced amount of the flush water to reach the forward portion of the bowl surface 8 so as to flush and clean a wider part of the bowl surface than in the prior art.

With reference to FIGS. 16 to 19, an automated toilet flushing unit 104 will be described. The automated toilet flushing unit 104 comprises a main water supply pipe 14 for supplying a flush water from a source such as water supply, a first water supply pipe (not shown) into which the flush water supplied, a first flow-controller (not shown) disposed in the first water supply pipe, a first on-off valve (not shown) attached to the first water supply pipe for supplying and interrupting the flow of the flush water, a spreader 128 connected to the first water supply pipe for functioning as a flush water discharge part, a proximity sensor 30 for detecting the presence of the user and more particularly the human body thereof, and a control unit 32 for controlling the first valve or the like on the basis of the detection signal from the proximity sensor 30, a predetermined control program contained therein.

As can be seen, in the automated toilet flushing unit 104 of the urinal 10 according to the second embodiment of the present invention, the flush water may be supplied to the spreader 128 through only one flow path from the main water supply pipe 14 (in other word, through a single flow system) and correspondingly, the spreader 128 may be provided with only one supply passage (supply flow path).

The first flow control device (not shown) is a constant flow valve which can regulate the flush water passing through the first water supply pipe (not shown) to an appropriate constant flow. The first on-off valve (not shown) is a solenoid valve which is controlled by the control signal from the control unit 32 to open and close a flow passage defined by the first water supply pipe (not shown).

The proximity sensor 30 is an infrared sensor for detecting a user standing in front of the urinal 1 and the distance the user and the sensor. This proximity sensor 30 permits the control unit 32 to send a control signal when a user moves back to a predetermined distance after he have urinated. In response to this control signal, the first on-off valve (not shown) is opened to supply the flush water from the first water supply pipe (not shown) to the spreader 128 for washing the bowl surface 8 of the urinal 101.

The control unit 32 is configured to control the predetermined facility protection washing operation and the like in addition to the control of the first on-off valve (not shown) based on the detection signal from the proximity sensor 30.

Also, as shown in FIG. 16 etc., in the automated toilet flushing unit 104 of the urinal 101 according to the second embodiment of the present invention, the spreader 128 is attached to the front surface 7 of the housing part defining the interior chamber 6 in the front face portion 8*a* of the urinal body 102. The spreader 128 is disposed centrally at the upper region of the bowl surface 8 for discharging in such a manner to spread the flush water from the central region of the bowl surface in the leftward and rightward directions toward the left and right side edges of the bowl surface, respectively.

The spreader 128 comprises a first flush water discharge opening 144 adapted to discharge the flush water in the leftward and rightward directions from the central area to the light and right side edges of the bowl surface 8 and a first water supply passage (not shown) for supplying the flush water to the first flush water discharge opening 144. The spreader 128 in the urinal 101 according to the second embodiment of the present invention can has only one supply passage (supply flow path) provided therein and also only one first water discharge opening 144 adapted to discharge the flush water onto the bowl surface 8.

In such a manner, the spreader 128 in the urinal 101 according to the second embodiment of the present invention is adapted to discharge the flush water in such a manner to spread the flush water in the leftward and rightward directions from the central area to the light and right side edges of the bowl surface 8. FIG. 16 illustrates a flow indicated by arrow A of the flush water which is discharged from the spreader 128. The bowl surface 8 may allow the flush water which is discharged from the spreader 128 to be guided in the leftward and rightward directions from the central area toward the light and right side edges of the bowl surface 8*a* and thus reach an area in the vicinity of each of left and right side edges of the bowl surface 8 to thereby flush and clean a wider part of the bowl surface than in the prior art.

In the arrangement of the second embodiment of the present invention, the flush water which has been discharged from the spreader 128 to spread in the leftward and rightward directions, can partly flow down toward the front side of the bowl surface 8 while being guided along the ledge 142 to reach the front side and clean a wider part of the bowl surface than in the prior art as well as reduce an area of the bowl surface 8 that is not cleaned by the flush water and provide an improved cleanliness and sanitation of the bowl surface 8.

Advantageous effects obtained by the urinal according to the second embodiment of the present invention will now be described.

In the urinal 101 according to the second embodiment of the present invention, the bowl surface 8 is arranged to spread the flush water being discharged from the spreader 128 provided on the bowl surface 8 centrally at its upper region, on the bowl surface 8 in the leftward and rightward directions toward the left and right side edges (the left side edge 8*b* and the right side edge 8*c*) of the bowl surface 8. Accordingly, the bowl surface 8 is devoid of any forwardly projecting side walls at its opposite sides thereof as in the prior art that can produce the area which is difficult to clean by means of the flush water. In the urinal 101 of the present invention, the flush water is discharged in such a manner to spread in the leftward and rightward directions and reach an area in the vicinity of each of left and right side edges of the bowl surface 8 to thereby flush and clean a wider part of the bowl surface than in the prior art as well as reduce an area of the bowl surface 8 that is not cleaned by the flush water and provide an improved cleanliness and sanitation of the bowl surface 8.

Also, in the urinal 101 according to the second embodiment of the present invention, the ledge 142 can serve to guide a portion of the flush water flowing down in the vicinity of the left and right sides (left side edge 8*b* and right side edge 8*c*) of the bowl surface toward the forward portion of the bowl surface 8 to reach the tip 8*f* of the bowl surface 8 to thereby flush and clean a wider part of the bowl surface 8 than in the prior art as well as reduce an area of the bowl surface 8 that is not cleaned by the flush water and provide an improved cleanliness and sanitation of the bowl surface 8.

Also, in the urinal 101 according to the second embodiment of the present invention, the ledge 142 can serve to guide a portion of the flush water flowing down in the vicinity of the left and right sides (left side edge 8*b* and right side edge 8*c*) of the bowl surface from the location near the middle height of the bowl surface, as viewed in the vertical direction to reach the forward portion of the bowl surface 8 to thereby flush and clean a wider part of the bowl surface than in the prior art as well as reduce an area of the bowl surface 8 that is not cleaned by the flush water and provide an improved cleanliness and sanitation of the bowl surface 8.

What is claimed is:

1. A urinal comprising:

a bowl surface adapted to receive urine of a user and to be cleaned by a flush water;

an automated toilet flushing unit including a proximity sensor for detecting a presence of the user and a flush water discharging device, the flush water discharging device being provided at an upper region of the bowl surface to discharge the flush water onto the bowl surface such that the flush water spreads on the bowl surface in leftward and rightward directions; and a housing chamber provided at an upper region of the urinal for housing a portion of the automated toilet flushing unit;

wherein said upper region of the bowl surface is provided with only a front face portion which faces the user, and said front face portion is formed by a concavely curved surface which extends continuously in leftward and rightward directions; and wherein horizontally extending lines normal to horizontally extending tangential lines defined on an inside portion of a left side edge and an inside portion of a right side edge of the concavely curved surface of the front face portion of the upper region of the bowl surface each extend toward the user standing in front of the bowl surface.

2. The urinal according to claim 1, wherein said flush water discharging device is configured to discharge the flush water such that it spreads diagonally upwardly on the bowl surface in the leftward and rightward directions, said front face portion of the upper region of the bowl surface is configured to incline rearwardly from the upper end to lower direction of the bowl surface.

3. The urinal according to claim 1, wherein said front face portion of the upper region of the bowl surface is configured to go backward gradually and continuously decrease radii of curvature from an upper end to a lower portion of the bowl surface.

4. The urinal according to claim 1, wherein said bowl surface is configured such that the left side edge and the right side edge of the bowl surface each project forwardly as they proceed toward a lower portion of the bowl surface.

5. The urinal according to claim 1, wherein said upper region of the bowl surface is provided within a distance of at least 200 mm from an upper end of the bowl surface.

6. The urinal according to claim 1, wherein said bowl surface is formed so as to spread the flush water toward the left side edge and the right side edge of the bowl surface, and said bowl surface is arranged so as to situate between a line segment connecting the left side edge and the right side edge and an arcuate segment of a circle having a diameter corresponding to said line segment, as viewed in a horizontal section through the flush water discharging device.

7. The urinal according to claim 6, wherein an angle between the line segment connecting the left side edge and the right side edge and tangent lines defined on the inside portion of the left side edge and the inside portion of the right side edge of the bowl surface is defined to be greater than 0° and equal to or smaller than 60°.

8. The urinal according to claim 6, wherein an angle between the line segment connecting the left side edge and the right side edge and tangent lines defined on the inside portion of the left side and the inside portion of the right side edge of the bowl surface is defined to be equal to or greater than 10° and equal to or smaller than 45°.

9. The urinal according to claim 6, wherein a depth of the bowl surface is in the range of 40 mm to 55 mm, as viewed in the horizontal section through the flush water discharging device.

10. The urinal according to claim 6, wherein the bowl surface includes, a left side ledge extending downwardly from a left side to a forward side of the bowl surface and right side ledge extending downwardly from a right side to the forward side of the bowl surface, and the left side ledge and the right side ledge both forwardly guide a portion of the flush water on the bowl surface.

11. The urinal according to claim 10, wherein said left side ledge and the right side ledge both are formed below a location at a middle height of the bowl surface.

12. The urinal according to claim 6, wherein the bowl surface has a single radius of curvature, as viewed in the horizontal section through the flush water discharging device is within the range from 200 mm to 500 mm.

13. The urinal according to claim 6, wherein said bowl surface is configured such that a radius of curvature of the concavely curved surface as viewed in the horizontal section continuously decreases downwardly from an upper end of the bowl surface.

* * * * *